US012559337B2

(12) United States Patent
Kazama

(10) Patent No.: US 12,559,337 B2
(45) Date of Patent: Feb. 24, 2026

(54) SHEET STACKER AND IMAGE FORMING APPARATUS

(71) Applicant: Ikumi Kazama, Kanagawa (JP)

(72) Inventor: Ikumi Kazama, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 18/633,515

(22) Filed: Apr. 12, 2024

(65) Prior Publication Data

US 2024/0351816 A1 Oct. 24, 2024

(30) Foreign Application Priority Data

Apr. 19, 2023 (JP) ..... 2023-068671

(51) Int. Cl.
*B65H 29/24* (2006.01)

(52) U.S. Cl.
CPC ... *B65H 29/247* (2013.01); *B65H 2301/4212* (2013.01); *B65H 2404/741* (2013.01); *B65H 2406/30* (2013.01); *B65H 2511/11* (2013.01); *B65H 2513/51* (2013.01); *B65H 2557/64* (2013.01)

(58) Field of Classification Search
CPC .. B65H 29/247; B65H 29/245; B65H 29/246; B65H 2406/121; B65H 2406/122; B65H 2406/1211; B65H 2511/11; B65H 2511/12; B65H 2511/10
See application file for complete search history.

(56) References Cited

U.S. PATENT DOCUMENTS 5,445,372 A * 8/1995 Blaser ..... B65H 43/00 271/211
2009/0166958 A1* 7/2009 Miwa ..... B65H 29/041 271/207
2014/0148321 A1* 5/2014 Hatano ..... B65H 5/228 493/56
2020/0130978 A1 4/2020 Tamura
2020/0299093 A1 9/2020 Tamura
(Continued)

FOREIGN PATENT DOCUMENTS

JP 2008-094582 4/2008
JP 2019-182655 10/2019
(Continued)

*Primary Examiner* — Luis A Gonzalez
(74) *Attorney, Agent, or Firm* — XSENSUS LLP

(57) ABSTRACT

A sheet stacker includes a stacking member, transporting member, guiding member, a plurality of blowers, and controller. A sheet is stacked on the sheet stacker. The transporting member transports a sheet in a sheet-transporting direction towards the stacking member. The guiding member retains an edge portion of the sheet transported by the transporting member in a standby position, followed by moving in the sheet-transporting direction to guide transporting of the sheet. The blowers discharge air flows towards the sheet transported to the stacking member. The air flows are directed towards a top plane of the stacking member. One of the blowers is disposed in a position corresponding to the detaching position. The controller controls motions of the blowers and air volumes from the blowers based on information regarding a length of the transported sheet.

18 Claims, 18 Drawing Sheets

(56) References Cited

U.S. PATENT DOCUMENTS

| | | | | |
|---|---|---|---|---|
| 2021/0395033 | A1 | 12/2021 | Kazama | |
| 2022/0234848 | A1* | 7/2022 | Tamura | B65H 29/125 |
| 2023/0127575 | A1 | 4/2023 | Kazama | |
| 2023/0286769 | A1 | 9/2023 | Kazama | |

FOREIGN PATENT DOCUMENTS

| | | |
|---|---|---|
| JP | 2020-158305 | 10/2020 |
| JP | 2022-025900 | 2/2022 |

* cited by examiner

SHEET STACKER AND IMAGE FORMING APPARATUS

CROSS-REFERENCE TO RELATED APPLICATION

The present application claims priority under 35 U.S.C. § 119 to Japanese Patent Application No. 2023-068671, filed Apr. 19, 2023, the contents of which are incorporated herein by reference in their entirety.

BACKGROUND OF THE INVENTION

1. Field of the Invention

The disclosures herein generally relate to sheet stackers and image forming apparatuses.

2. Description of the Related Art

Sheet stackers in image forming apparatuses using an electrophotographic process have been known. A sheet stacker generally includes a sheet-transporting device that transports a sheet while holding an edge of the transported sheet. The sheet-transporting device is driven to move at the same speed as a sheet-transporting speed, while sending out a rear edge of the sheet by a transporting member, thereby transporting and stacking the sheet.

The following technology associated with the sheet stacker has been known. A fan that discharges air blowing through a sheet-transporting path connecting from the transporting member to the sheet-transporting device is disposed in the sheet stacker. The fan discharges air towards the transported sheet to assist retention of the edge of the sheet with the sheet-transporting device, as well as cooling the sheet with the discharged air to avoid curling of the sheet due to heat (see, for example, Japanese Unexamined Patent Application Publication No. 2008-94582). As the edge of the sheet transported by the sheet-transporting device comes into contact with a sheet-edge regulator, the sheet is detached from the sheet-transporting device, and is allowed to free fall to be stacked onto a tray. In the sheet stacker, a sheet-rear press that is configured to hit a rear edge of the falling sheet towards the tray during the stacking is disposed.

Moreover, a technology of detaching a sheet, which is held with a sheet-transporting device, from the sheet-transporting device using a difference between a sheet-transporting speed of a transporting member and a sheet-transporting speed of the sheet-transporting device, followed by allowing the detached sheet to fall to be stacked onto a tray has been known (for example, see Japanese Unexamined Patent Application Publication No. 2019-182655). In the above-described technology, the sheet stacker is configured such that the speed of the sheet-transporting device is accelerated just before reaching a sheet-stacking position to increase a difference in the transporting speed between the sheet-transporting device and the sheet transported by the transporting member, thereby assuredly detaching the edge of the sheet from the sheet-transporting device. Once the edge of the sheet is detached from the sheet-transporting device, the sheet is allowed to free fall to be stacked onto the tray.

Moreover, the following technology has been known. A sheet-transporting speed of a sheet-transporting device that holds an edge of a sheet is accelerated at a predetermined position. Similar to the technology disclosed in Japanese Unexamined Patent Application Publication No. 2019-182655, the edge of the sheet is detached from the sheet-transporting device using a difference between a sheet-transporting speed of a transporting member and a sheet-transporting speed of the sheet-transporting device. Air is blown onto the detached sheet from a blower disposed above the detached sheet (see, for example, Japanese Unexamined Patent Application Publication No. 2020-158305). In the above-described technology, after the edge of the sheet is detached from the sheet-transporting device, falling of the detached sheet is accelerated by an air flow discharged from the blower to be stacked onto a tray. At the time when the sheet is stacked on the tray, the air flow discharged from the blower is blown onto the surface of the falling sheet to push out the air trapped between stacked sheets on the tray, thereby releasing air between the sheets.

Moreover, the following sheet stacker has been known. The sheet stacker includes a transporting system configured to transport a sheet, a process tray where the sheet discharged from the transporting system is stacked in a position downstream of a sheet-discharging path, a blower that blows air towards a surface of the sheet discharged from the transporting system to guide the sheet downwards, a processing system that sorts the sheets stacked on the process tray into a bundle, a discharging system that discharges the sheet bundle, which has been sorted by the processing system, from the process tray, and a stacking tray on which sheet bundles discharged by the discharging system are stacked (see, for example, Japanese Unexamined Patent Application Publication No. 2022-25900). In the above-described technology, the blower blows out air towards substantially the center of a sheet that is substantially horizontally discharged from the transporting system. The blown air changes the direction of the discharged sheet to the direction towards a stacking surface of the process tray so that the sheet is received on the process tray.

SUMMARY OF THE INVENTION

In one embodiment, a sheet stacker includes a stacking member, a transporting member, a guiding member, a plurality of blowers, and a controller. A sheet is stacked on the stacking member. The transporting member transports the sheet in a sheet-transporting direction towards the stacking member. The guiding member retains an edge portion of the sheet transported by the transporting member in a standby position, followed by moving in the sheet-transporting direction to guide transporting of the sheet. The edge portion of the sheet retained by the guiding member is detached from the guiding member in a detaching position using a difference between a sheet-transporting speed of the transporting member and a traveling speed of the guiding member. The detached sheet is allowed to fall and to be stacked on the stacking member. The plurality of the blowers discharge air flows towards the sheet transported to the stacking member. The air flows are directed towards a top plane of the stacking member. One of the plurality of the blowers is disposed in a position corresponding to the detaching position. The controller controls motions of the plurality of the blowers and air volumes from the plurality of the blowers based on information regarding a length of the transported sheet.

DESCRIPTION OF THE PREFERRED EMBODIMENTS

In a sheet stacker of the related art having the above-described structure, a technology of combining a sheet-transporting device that holds an edge of a sheet, which is disclosed in each of Japanese Unexamined Patent Application Publication No. 2008-94582, Japanese Unexamined Patent Application Publication No. 2019-182655, and Japanese Unexamined Patent Application Publication No. 2020-158305, and an air blowing member disclosed in each of Japanese Unexamined Patent Application Publication No. 2008-94582, Japanese Unexamined Patent Application Publication No. 2020-158305, and Japanese Unexamined Patent Application Publication No. 2022-25900 may be considered. According to the technology as mentioned, a sheet may be potentially allowed to fall on a predetermined stacking position by the sheet-transporting device, and a falling speed of the sheet may be increased by the air blowing member so that a collision of the sheet with a sequentially transported sheet may be potentially avoided.

According to the above-described structure, however, the following problems may occur. A position at which an edge of a sheet is detached from the sheet-transporting device is generally varied depending on a length of the sheet along the sheet-transporting direction. In the above-described structure, the position of the air blowing member and an air volume discharged by the air blowing member are fixed. Therefore, blown air may be too strong for a sheet depending on a size of the sheet so that the sheet may be dropped from the sheet-transporting device during transporting. As another problem, moreover, blown air may be weaken at a downstream side of the detaching position in the sheet-transporting direction, which may cause reduction in a falling speed of the detached sheet, thereby causing a collision of the sheet with a sequentially transported sheet before the sheet lands.

The present disclosure aims to solve the above-described problems, and to provide a sheet stacker that can minimize dropping of sheets during transporting regardless of a size of the sheets, and can accelerate a sheet-transporting speed.

In the following, embodiments of the present invention will be described with reference to the accompanying drawings.

Further, the present invention is not limited to these embodiments, but various variations and modifications may be made without departing from the scope of the present invention.

Figure 1:
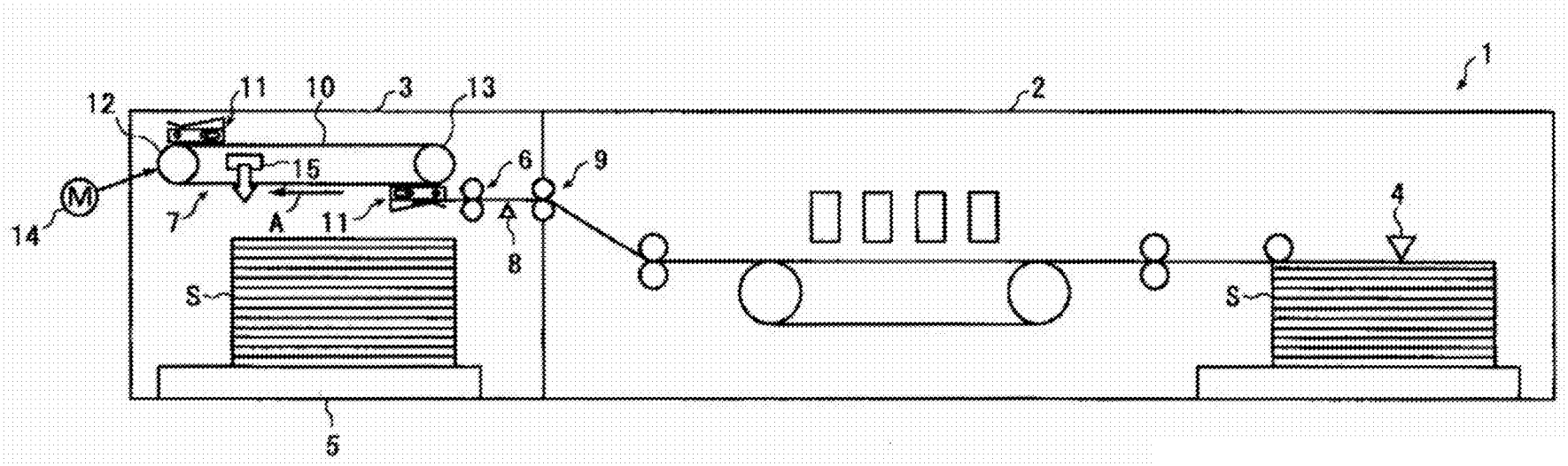
FIG.1 Related Art
FIG. 1 is a schematic front view illustrating an example of an image forming apparatus of the related art, to which an embodiment of the present disclosure can be applied.

FIG. 1 illustrates an example of an image forming apparatus of the related art, to which the present disclosure can be applied. In FIG. 1, the image forming apparatus 1 includes an image forming mechanism 2 and a sheet stacker 3. The image forming mechanism 2 forms an image on each of transfer sheets S that are sheets serving as recording media. The sheet stacker 3 transports and piles up the transfer sheets S on which images are formed by the image forming mechanism 2.

The image forming mechanism 2 includes an inkjet recording device and a sheet feeder. The inkjet recording device is configured to eject inks of four colors, black (K), cyan (C), magenta (M), and yellow (Y), onto each transfer sheet S to form a full-color image on the transfer sheet S. The sheet feeder is configured to feed transfer sheets S to the inkjet recording device. Moreover, the image forming mechanism 2 includes sheet-size detection sensors 4 each configured to detect a size of transfer sheets S to be fed. A plurality of the sheet-size detection sensors 4 are disposed so that a length and width of each transfer sheet S can be detected.

The sheet stacker 3 includes a sheet tray 5 serving as a stacking member, a transporting member 6, a guiding member 7, and a sheet-edge detection sensor 8.

A plurality of the transfer sheets S on which image formation has been performed are stacked on the sheet tray 5 that is disposed at the bottom of the sheet stacker 3. An operator may draw the sheet tray 5 out from the sheet stacker 3 to take out the transfer sheets S stacked on the sheet tray 5.

The transporting member 6 transports the transfer sheet S fed from the image forming mechanism 2 to the sheet tray 5. The transporting member 6 contains a pair of rollers available in the related art, including a driving roller and a driven roller. The transporting member 6 receives the transfer sheet S discharged by paper ejection rollers 9 in the image forming mechanism 2, and transports the received transfer sheet S towards the downstream in the sheet-transporting direction indicated with the arrow A.

The sheet-edge detection sensor 8 is arranged upstream of the transporting member in the sheet-transporting direction A, and detects an edge of the transported transfer sheet S to output a detection signal.

The guiding member 7 is disposed downstream of the transporting member 6 in the sheet-transporting direction A. The guiding member 7 retains an edge portion of the transfer sheet S transported by the transporting member 6 so that the guiding member 7 can transport the transfer sheet S to the sheet-transporting direction A at the speed faster than the sheet-transporting speed of the transporting member 6. The guiding member 7 guides the transported transfer sheet S to be stacked onto the sheet tray 5.

The guiding member 7 includes a conveyor belt 10 that is an endless loop movably supported by a driving roller 12 and a driven roller 13, and a retaining member 11 that is attached onto the conveyor belt 10 and moves in conjunction with the movement of the conveyor belt 10. A below-described controller 16 controls motions of a motor 14 for driving the driving roller 12 to vary a belt speed of the conveyor belt 10. The motor 14 is a speed-variable stepper motor. The sheet stacker is configured to determine the position of the retaining member 11 on the conveyor belt 10 based on the step number of the stepper motor.

In the sheet stacker 3, the transfer sheet S retained by the retaining member 11 is detached from the retaining member 11 using a difference in the sheet-transporting speed between the transporting member 6 and the guiding member 7, and the detached transfer sheet S is then stacked on the sheet tray 5.

A blower fan 15 is disposed at the downstream side of the guiding member 7 in the sheet-transporting direction. The blower fan 15 discharges an air flow to the transported transfer sheet S, and the air flow is directed towards the top plane of the sheet tray 5, specifically, in the downward direction. The blower fan 15 is constantly operated.

Figure 2:
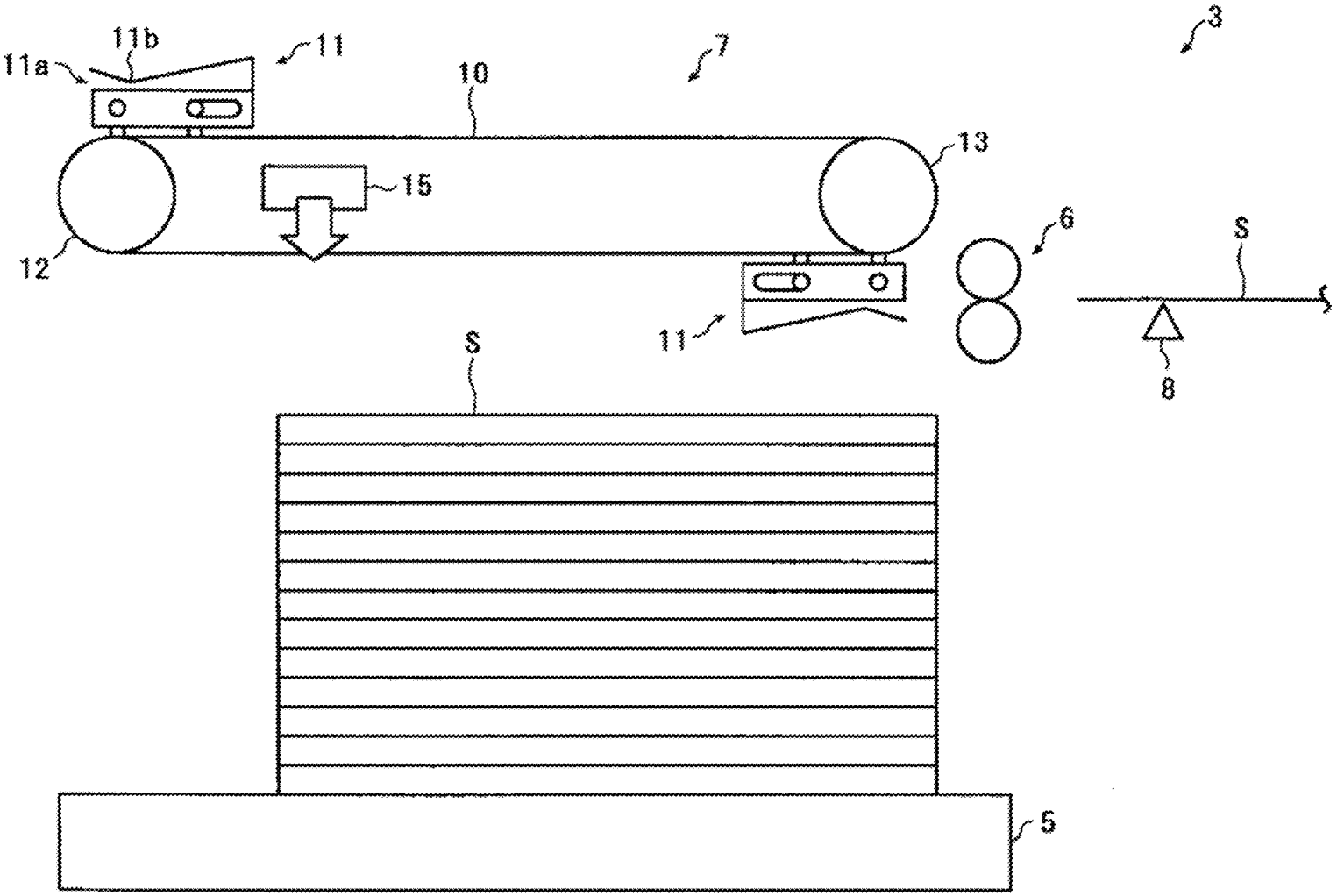
FIG.2 Related Art
FIG. 2 is a schematic front view illustrating an example of a sheet stacker of the related art, in which a retaining member is present in a standby position.

As illustrated in FIG. 2, the retaining member 11 includes an opening 11*a* into which an edge portion of a transfer sheet S is inserted, and a catching member 11*b* that holds the edge portion of the transfer sheet S inserted from the opening 11*a*. The force of holding the edge portion of the transfer sheet S with the catching member 11*b* is set such that the force of holding the edge portion of the transfer sheet S with the catching member 11*b* is smaller than the frictional force between the transporting member 6 and the transfer sheet S. Therefore, the catching member 11*b* of the retaining member 11 stopped in the standby position illustrated in FIG. 2 utilizes the rigidness of the transfer sheet S to allow the transfer sheet S, which is transported by the transporting member 6 and is inserted from the opening 11*a*, to enter the catching member 11*b*. The catching member 11*b* utilizes elasticity of the entered transfer sheet S to retain the transfer sheet S.

The surfaces of the retaining member 11 that come into contact with a transfer sheet S are preferably formed of a material having high smoothness, such as metals and resins. Use of the above-mentioned material in the contact surfaces of the retaining member 11 enables the retaining member 11 to retain a transfer sheet S smoothly.

At the time when the retaining member 11 receives a transfer sheet S, the retaining member 11 is stopped in the standby position illustrated in FIG. 2. After detecting an edge of a transfer sheet S by the sheet-edge detection sensor 8 and holding the edge portion of the transfer sheet S with the catching member 11*b*, the retaining member 11 is actuated to transport the transfer sheet S at a predetermined timing. Once the transporting of the transfer sheet S is completed, the retaining member 11 is returned back to and stopped in the standby position by the rotation of the conveyor belt 10.

As illustrated in FIGS. 1 and 2, an embodiment of the arrangement of the retaining member 11 in the image forming apparatus 1 is as follows. Two retaining members 11 are disposed on the outer circumferential surface of the conveyor belt 10 in a manner such that phases of the two retaining members 11 are different from each other by 180 degrees. Therefore, the time for returning the retaining member 11 back to the standby position is shortened, thereby improving transporting cycles of transfer sheets S.

Figure 3:
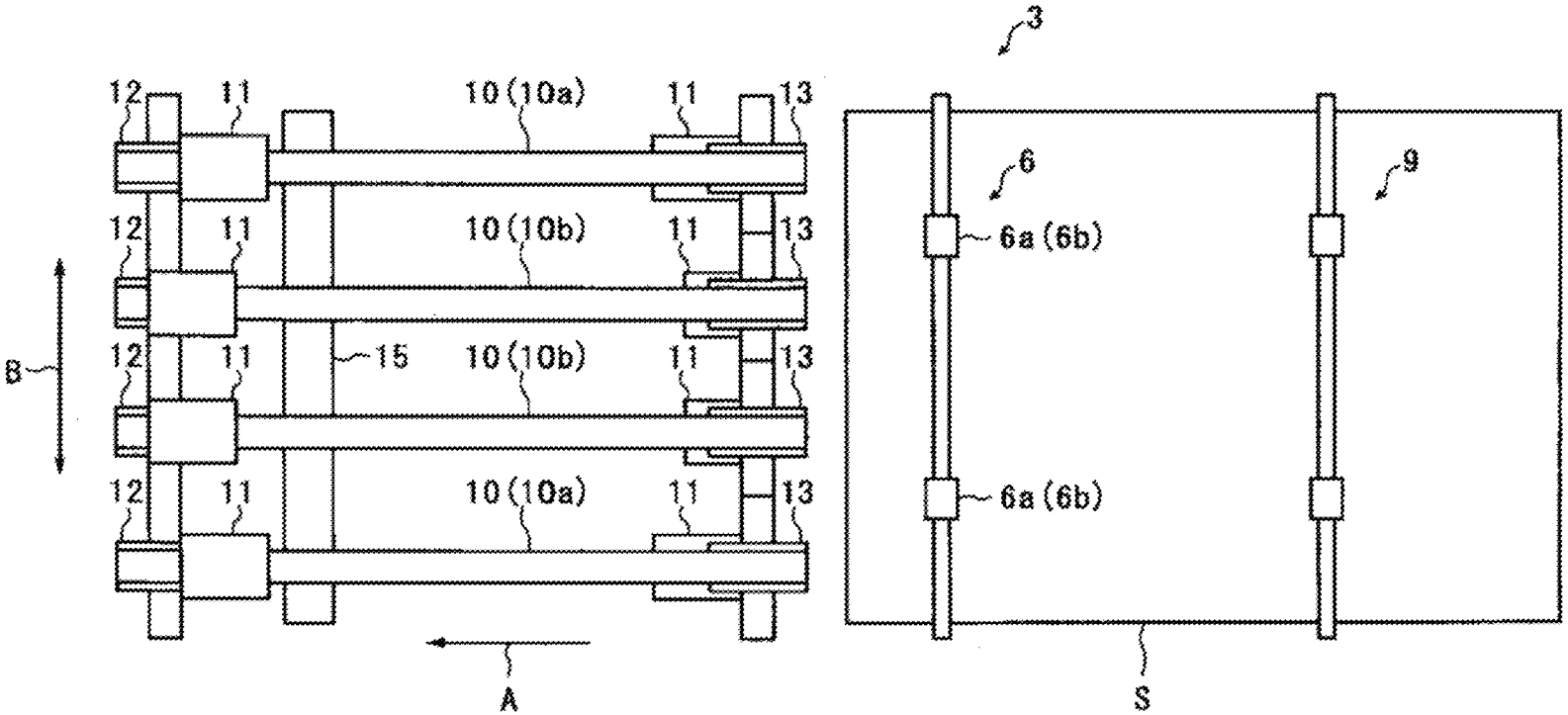
FIG.3 Related Art
FIG. 3 is a schematic plan view of illustrating an example of a sheet stacker of the related art, in which a retaining member is present in a standby position.

As illustrated in FIG. 3, as the conveyor belt 10, four conveyor belts 10 are aligned across the sheet-width direction B in the image forming apparatus 1. The sheet-width direction B is orthogonal to the sheet-transporting direction A. Each of the conveyor belts 10 is equipped with two retaining members 11. Therefore, the size of each retaining member 11 can be reduced compared to the case of the structure where one or two conveyor belts 10 are disposed and two retaining members 11 are disposed per belt, thereby reducing the inertial load during driving of the conveyor belt 10. In addition, a retained state of a transfer sheet S can be stabilized, as the number of the retaining members 11 is increased.

The four conveyor belts 10 are classified into side belts 10*a* positioned at side edges relative to the side-width direction B, and center belts 10*b* disposed between the side belts 10*a*. The retaining members 11 on each belt are arranged in a manner that the positions of the retaining members 11 in the sheet-transporting direction A are different between the side belt 10*a* and the center belt 10*b*. Specifically, the retaining members 11 on the center belt 10*b* are disposed upstream of the retaining members 11 on the side belt 10*a* in the sheet-transporting direction A, respectively.

Because of the above-described structure, timing for retaining a transfer sheet S with the retaining members 11 can be shifted between the side belts 10*a* and the center belts 10*b*, thereby reducing a load when the transfer sheet S enters the retaining members 11. Moreover, the timing for detaching the transfer sheet S from the retaining members 11 is also shifted so that a stable state of a transfer sheet S is maintained.

As illustrated in FIG. 3, the transporting member 6 includes two pairs of rollers, the above-described driving roller 6*a* and driven roller 6*b*. The two pairs of the rollers are disposed in a divided manner such that each pair is positioned between the conveyor belts 10. Moreover, the paper ejection rollers 9 disposed in the image forming mechanism 2 also include two pairs of rollers, similarly to the transporting member 6. The two pairs of the paper ejection rollers 9 are arranged in the positions corresponding to the transporting member 6 in the sheet-width direction B.

Figure 4:
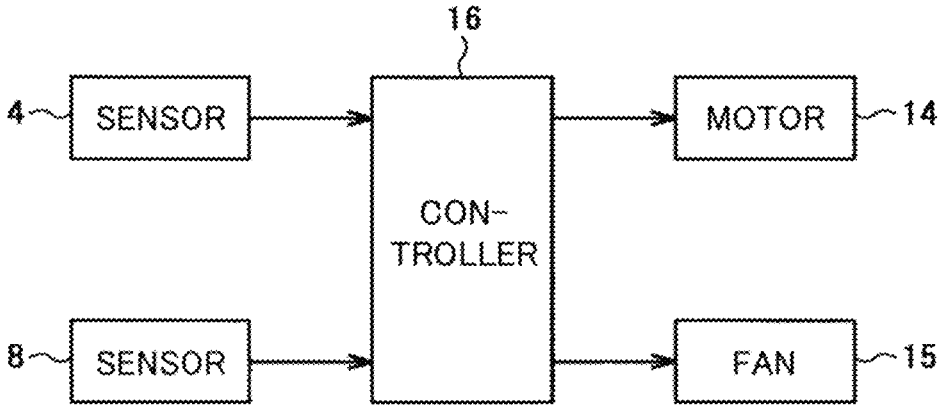
FIG.4 Related Art
FIG. 4 is a block diagram depicting an example of a controller used for a sheet stacker of the related art.

FIG. 4 is a control block diagram depicting an example of a controller 16 that controls motions of the sheet stacker 3. The controller 16 is composed of any microcomputer available in the related art, including CPUs, ROMs, RAMs, etc. The controller 16 receives input signals or input information from the sheet-size detection sensor 4, the sheet-edge detection sensor 8, and other sensors, and controls motions of various actuators in the sheet stacker 3, such as the motor 14 and the blower fan 15.

Next, a sheet transporting process using the above-described sheet stacker 3 of the related art will be described.

First, the sheet stacker 3 acquires information regarding a length of a transfer sheet S, which will be transported and stacked, from the image forming mechanism 2. Specifically, size information based on the length and width of the transfer sheet S detected by the sheet-size detection sensor 4, or size information of the transfer sheet S input from a control panel (not illustrated) of the image forming mechanism 2 by an operator is used. Next, the transporting member 6 is driven together with driving of the image forming mechanism 2, and transporting of the transfer sheet S, which is sent from the image forming mechanism 2 by the paper ejection rollers 9, starts. At the time when the transporting of the transfer sheet S is started, the guiding member 7 is stopped in a standby state as illustrated in FIG. 2, where the retaining member 11 is stopped in the standby position, and the blower fan 15 is actuated so that a predetermined air volume is constantly maintained.

Then, whether the sheet-edge detection sensor 8 detects an edge of the transfer sheet S is determined. If it is determined that the edge of the transfer sheet S is detected, a first scheduled time is measured. The first scheduled time is a time lapse measured from a starting point that is the detection time of the edge of the transfer sheet S. The first scheduled time is determined in advance according to a size of the transfer sheet S that will be transported. As the first scheduled time passes, the conveyor belt 10 starts to move so that the retaining member 11 retained in the standby position starts moving in the sheet-transporting direction A. At the time when the retaining member 11 starts moving, the transporting speed of the transfer sheet S by the transporting member 6 is faster than the traveling speed of the retaining member 11. Therefore, the edge portion of the transfer sheet S enters the retaining member 11 from the opening 11*a*, and the entered edge portion of the transfer sheet S is retained by holding the edge portion of the transfer sheet S with the catching member 11*b*.

Figure 5:
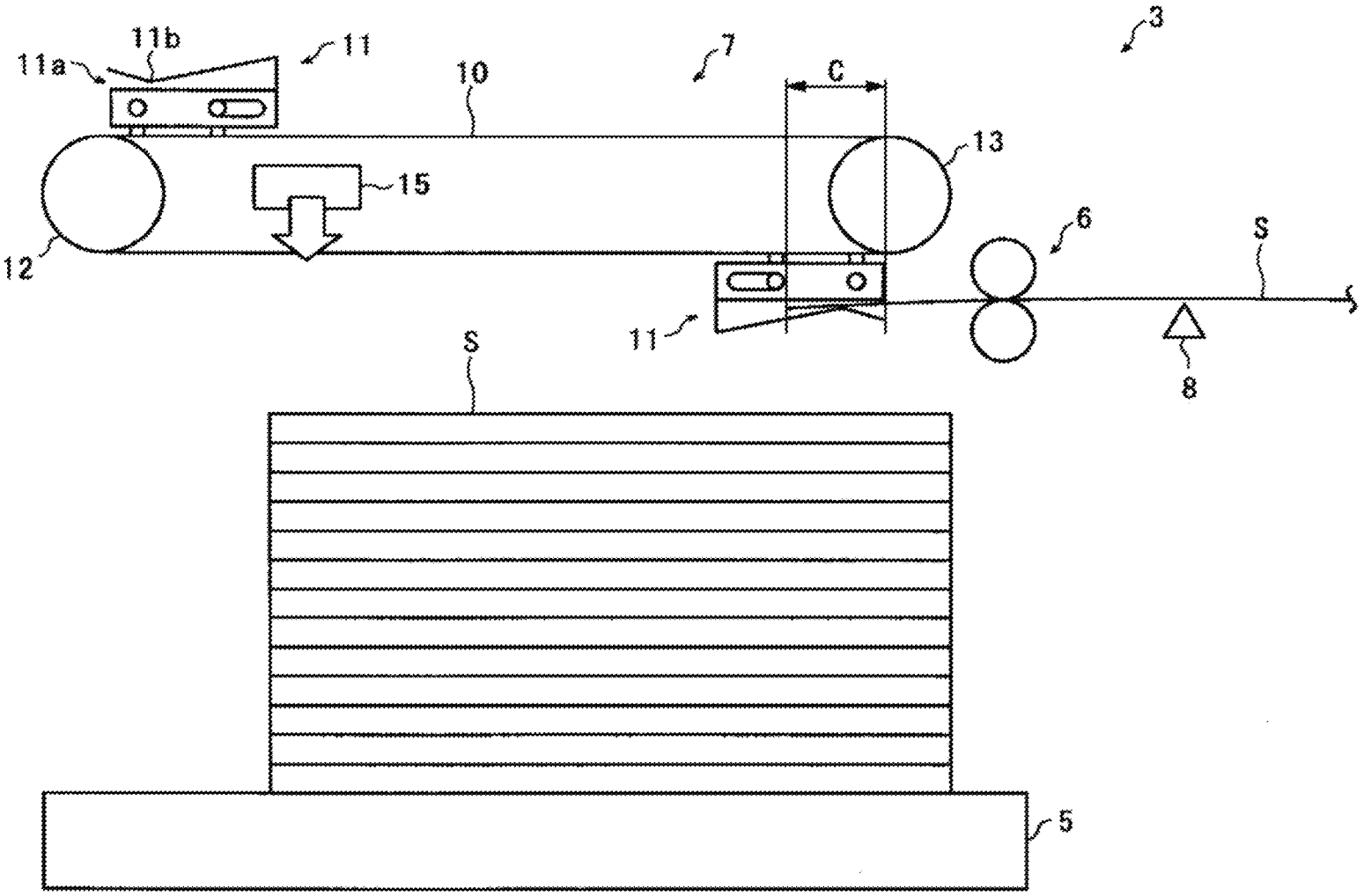
FIG.5 Related Art
FIG. 5 is a schematic front view illustrating an example of a sheet stacker of the related art in a state where a predetermined amount of an edge portion of a transfer sheet enters a retaining member.

When the entry of the transfer sheet S into the retaining member 11 is completed, the controller 16 controls the traveling speed of the retaining member 11, namely, the driving speed of the motor 14 for driving the conveyor belt 10 in a manner such that the transporting speed of the transfer sheet S by the transporting member 6 is equal to the traveling speed of the retaining member 11. As described above, the edge portion of the transfer sheet S enters the retaining member 11 owing to a difference in the speed until the traveling speed of the retaining member 11 becomes equal to the transporting speed of the transfer sheet S by the transporting member 6. The period from the time when the retaining member 11 starts moving to the time when the entry of the transfer sheet S into the retaining member 11 is completed is determined as a second scheduled time. An amount of the entered edge portion of the transfer sheet S into the retaining member 11 corresponding to the first and second scheduled times is a predetermined amount C illustrated in FIG. 5.

When the retaining member 11 retains the transfer sheet S, specifically, when the amount of the entered edge portion of the transfer sheet S into the retaining member 11 reaches the predetermined amount C, first acceleration of the traveling speed of the retaining member 11 is carried out, and a third scheduled time according to the size information of the transfer sheet S, which is acquired in advance, is measured. The transporting of the transfer sheet S by the transporting member 6 and the guiding member 7 is started using a difference in the speed caused by the first acceleration, which is a difference between the transporting speed of the transfer sheet S by the transporting member 6 and the traveling speed of the retaining member 11. At the time when the transporting of the transfer sheet S is started, the traveling speed of the retaining member 11 becomes faster than the transporting speed of the transfer sheet S by the transporting member 6. Therefore, the transfer sheet S is transported, while the edge portion of the transfer sheet S is pulled by the retaining member 11, so that flexure of the transfer sheet S can be minimized compared to when the traveling speed of the retaining member 11 and the transporting speed of the transfer sheet S are identical. During the transporting, the force of retaining the transfer sheet S with the retaining member 11 is smaller than the frictional force between the transporting member 6 and the transfer sheet S. Therefore, the transfer sheet S is gradually released out from the retaining member 11, but the state where the transfer sheet S is retained in the retaining member 11 is maintained from the position where the transfer sheet S is retained to the position where the transfer sheet S is detached.

Figure 6:
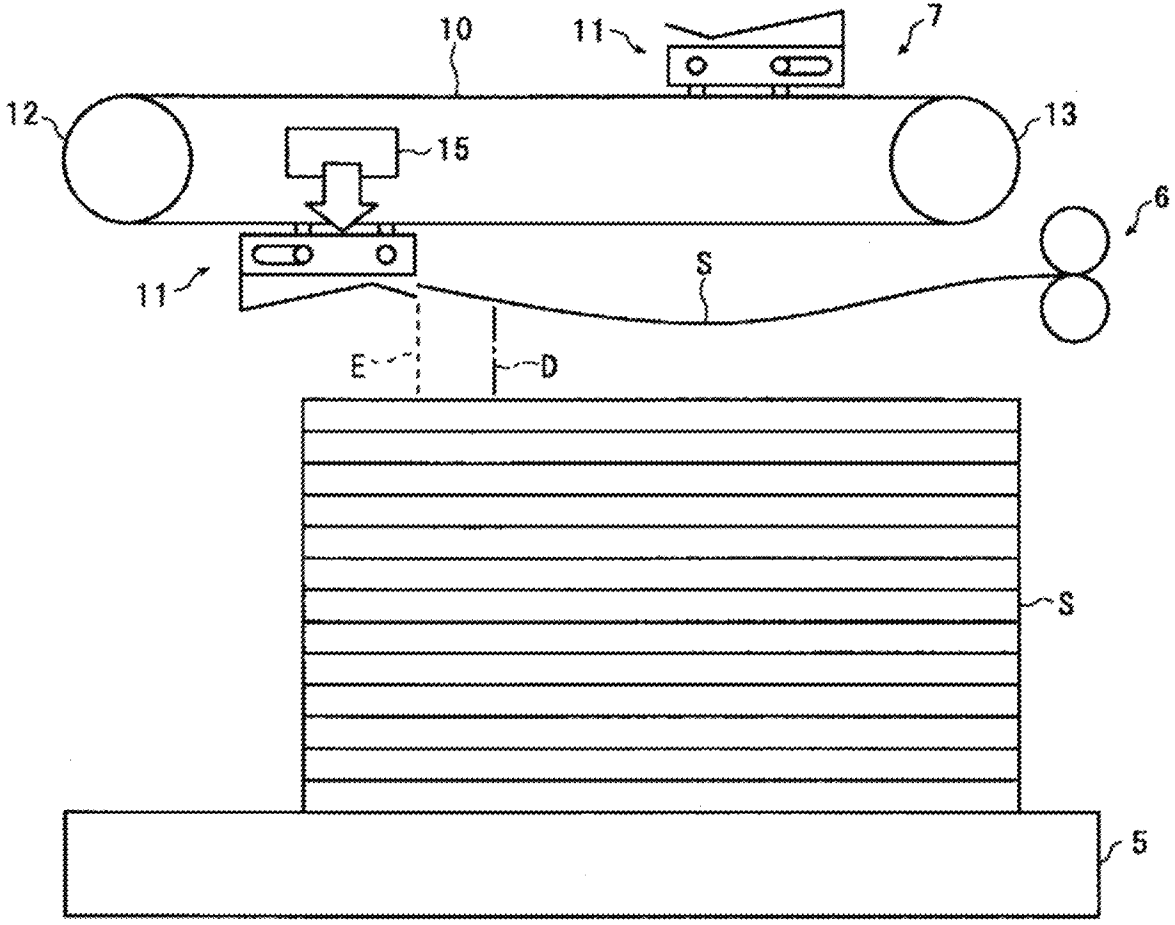
FIG.6 Related Art
FIG. 6 is a schematic front view illustrating an example of a sheet stacker of the related art in a state where a transfer sheet is detached from a retaining member.
Figure 7:
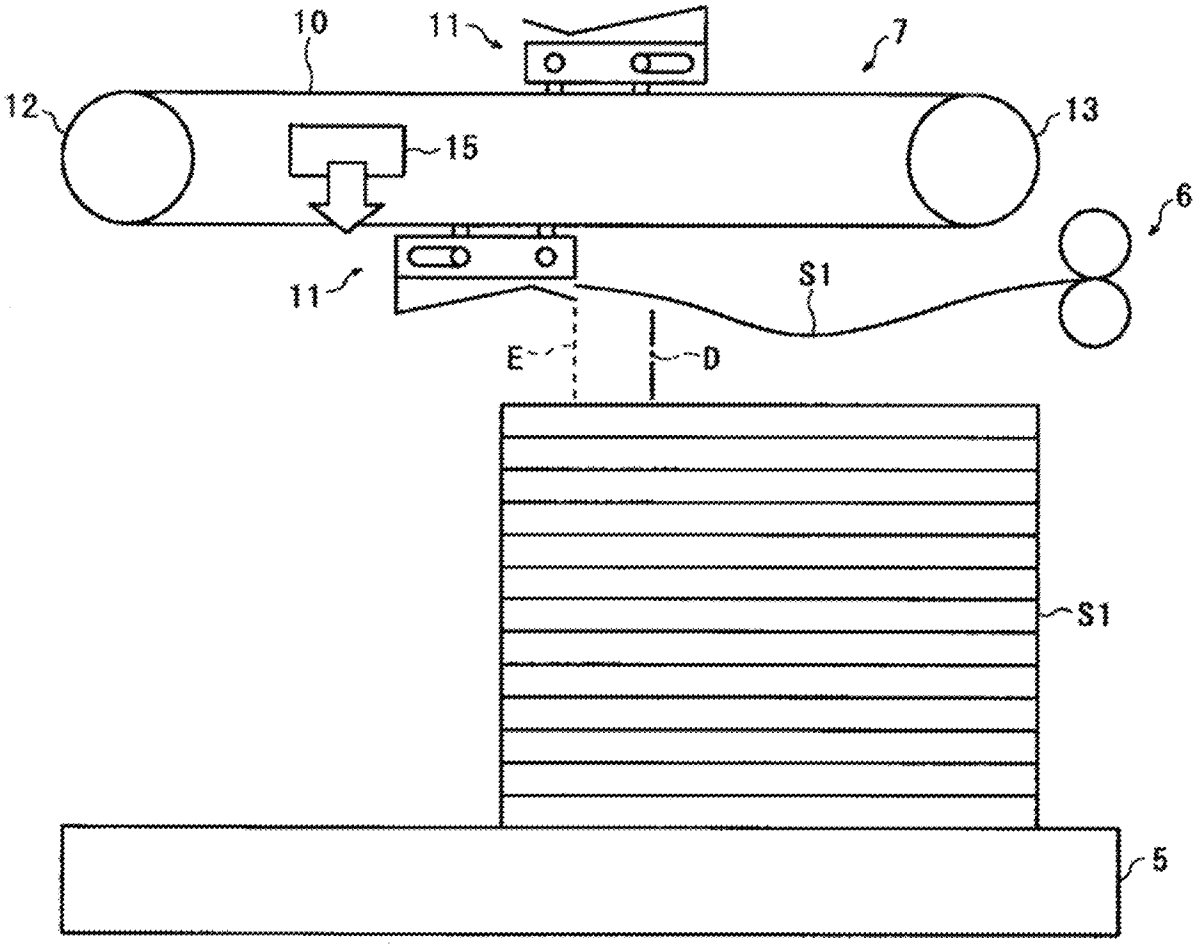
FIG.7 Related Art
FIG. 7 is a schematic front view illustrating an example of a sheet stacker of the related art in a state where a small-size transfer sheet is detached from a retaining member.

As the third scheduled time passes after retaining the transfer sheet S with the retaining member 11, the second acceleration of the traveling speed of the retaining member 11 is carried out to further increase the traveling speed of the retaining member 11, thereby detaching the transfer sheet S from the retaining member 11. Even if the transfer sheet S is released from the transporting member 6 before detaching the transfer sheet S from the retaining member 11, detachment of the transfer sheet S from the retaining member 11 is carried out by the inertial force of the transfer sheet S. The state where the transfer sheet S is detached from the retaining member 11 is illustrated in FIG. 6. In FIG. 6, the referential sign D represents an acceleration position that is a position of the retaining member 11 at which the second acceleration is carried out, and the referential sign E represents a detaching position that is a position of the retaining member 11 at which the detachment of the transfer sheet S is carried out. FIG. 7 illustrates an example where a small-size transfer sheet S1, which is smaller than the transfer sheet S, is used instead of the transfer sheet S.

As described above, the detachment of the transfer sheet S from the retaining member 11 is carried out using a difference in speed caused by the second acceleration, which is a difference between the transporting speed of the transfer sheet S by the transporting member 6 and the traveling speed of the retaining member 11. The transfer sheet S released from the transporting member 6 and detached from the retaining member 11 falls down towards the sheet tray 5 while receiving a force of wind from the blower fan 15, and is stacked on the sheet tray 5.

Once the transfer sheet S is detached from the retaining member 11, a fourth scheduled time according to the size information of the transfer sheet S, which is acquired in advance, is measured. When the fourth scheduled time passes, the retaining member 11 begins to deaccelerate to stop the retaining member 11 in the standby position. Then, whether the image forming operation in the image forming mechanism 2 is completed or not is determined. When it is determined that the image forming operation has not been completed, whether the sheet-edge detection sensor 8 has detected an edge of a transfer sheet S or not is determined, and the above-described series of processes is repeated until the image forming operation is completed. When it is determined that the image forming operation has been completed, motions of the transporting member 6 and the blower fan 15 are stopped.

Problems associated with the above-described sheet stacker 3 will be described hereinafter. A single blower fan 15 is disposed in the above-described sheet stacker 3, and the position of the blower fan 15 is fixed. Moreover, the air volume from the blower fan 15 is always constant. Therefore, the following problems may occur.

Figure 8:
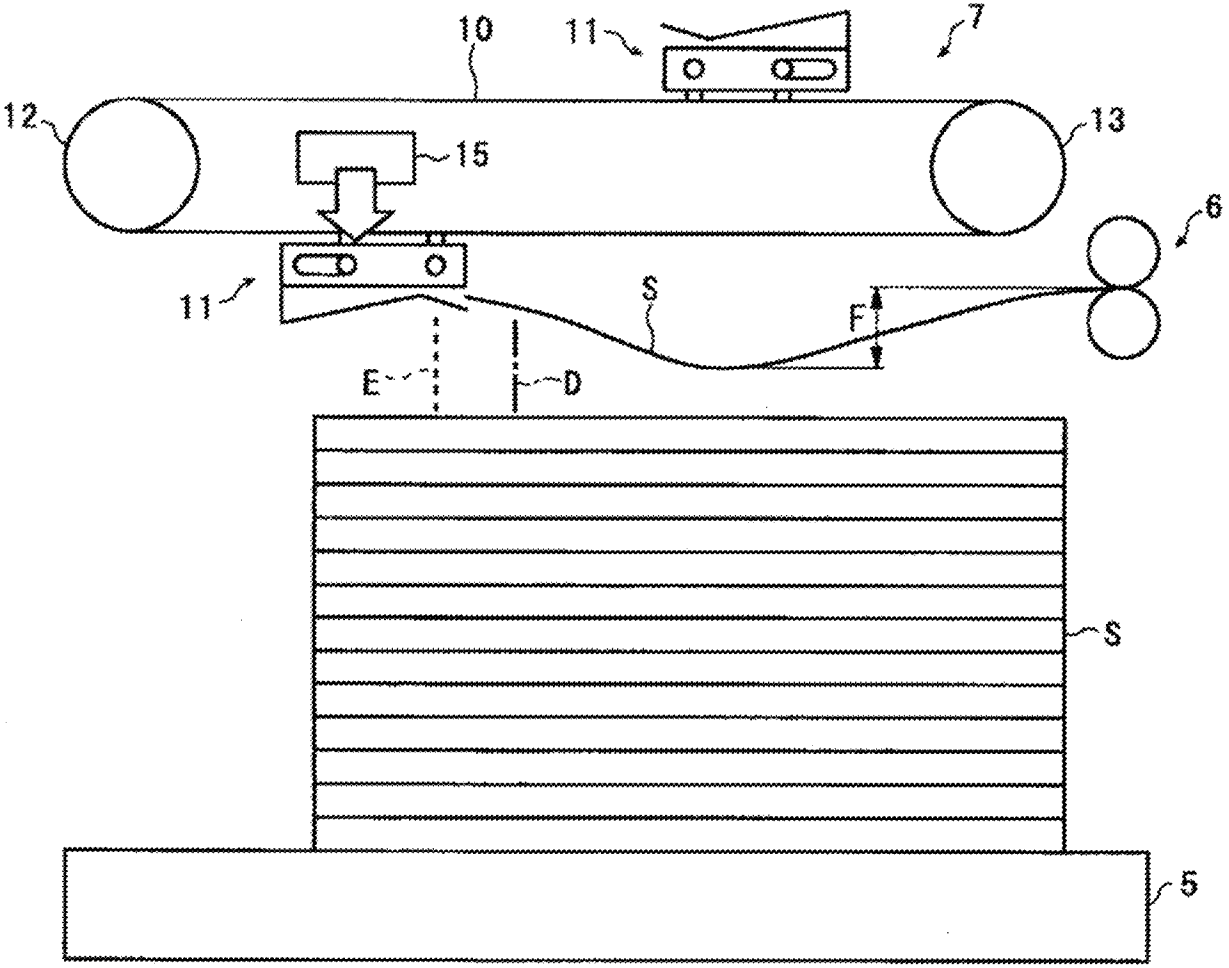
FIG.8 Related Art
FIG. 8 is a schematic view illustrating a problem associated with a sheet stacker of the related art.

If a transfer sheet S retained with retaining member 11 reaches the detaching position E after moving the retaining member 11 from the standby position and accelerating at the acceleration position D, the transfer sheet S is detached from the retaining member 11 to free fall onto the sheet tray 5. During free fall, the transfer sheet S receives the force of wind from the blower fan 15 to accelerate the speed of falling. If the air volume from the blower fan 15 is great relative to the size of the transfer sheet S, the transfer sheet S receives the force of the wind to increase the amount F of the flexure compared to a regular case, as illustrated in FIG. 8. Therefore, the transfer sheet S is detached from the retaining member 11 in a position that is upstream of the detaching position E in the sheet-transporting direction A. In the above-described case, the falling position of the transfer sheet S relative to the sheet tray 5 is shifted from a typical position so that misalignment of a stacking position of the transfer sheet may occur on the sheet tray 5.

Figure 9:
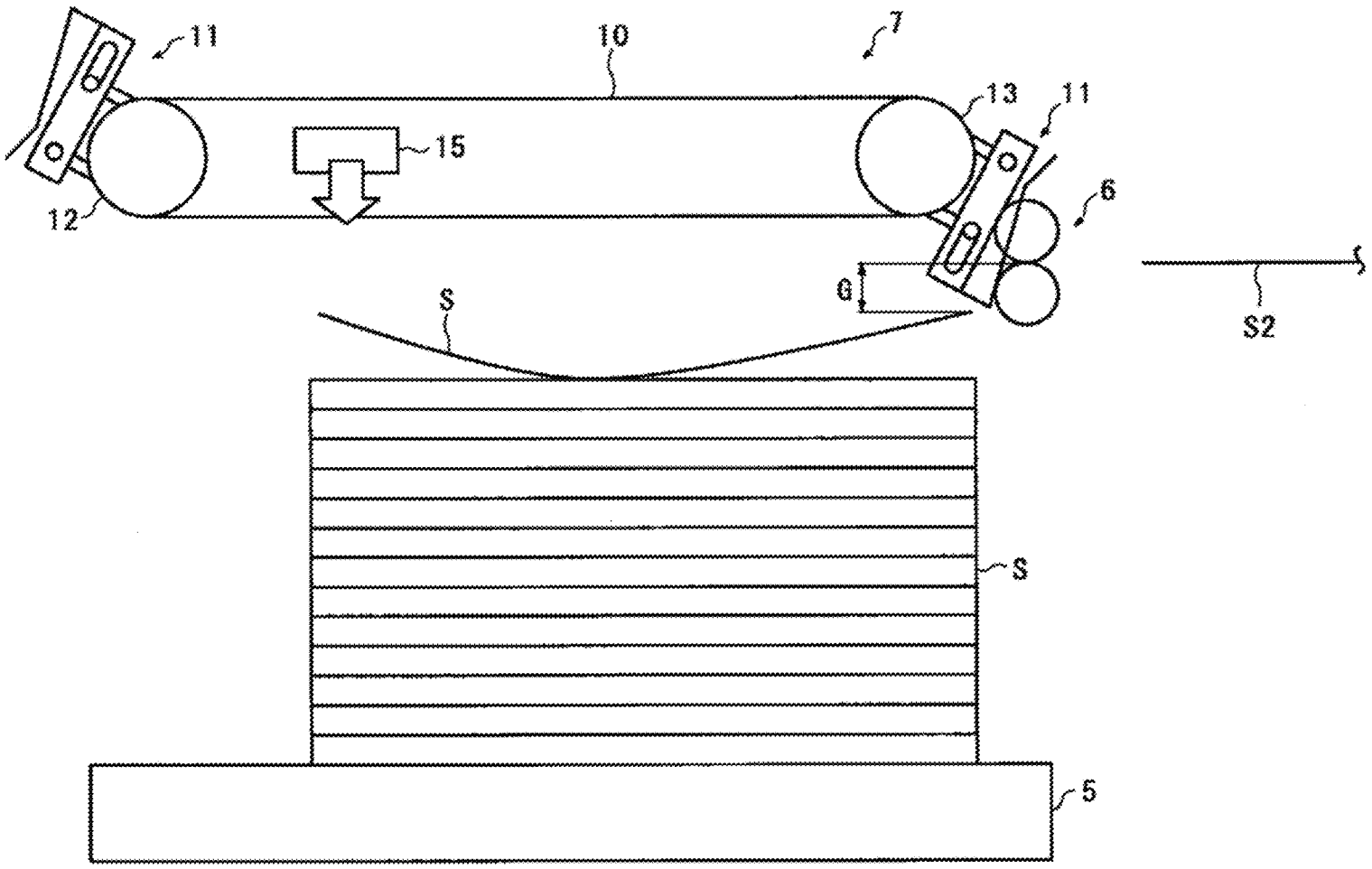
FIG.9 Related Art
FIG. 9 is a schematic view illustrating a problem associated with a sheet stacker of the related art.

As described above, moreover, the transfer sheet S detached from the retaining member 11 in the detaching position E free falls towards the sheet tray 5, and during the fall, the transfer sheet S receives the force of wind from the blower fan 15 to accelerate the speed of the falling of the transfer sheet S. Since the position of the blower fan 15 is fixed, if the air volume from the blower fan 15 is small relative to the size of the transfer sheet S, the falling speed of the transfer sheet S after detaching from the retaining member 11 becomes slow, thereby reducing a falling amount as illustrated in FIG. 9. If the falling amount G is small, a sequential transfer sheet S2, which is a sequential sheet that follows the transfer sheet S, may start being transported before the transfer sheet S reaches the sheet tray 5. In such a case, the retaining member 11 traveling from the detaching position E to the standby position may collide with the falling transfer sheet S to cause a misalignment of the stacking position of the transfer sheet on the sheet tray 5.

Embodiments of the structure of the present disclosure for solving the above-described problems will be described hereinafter.

Figure 10:
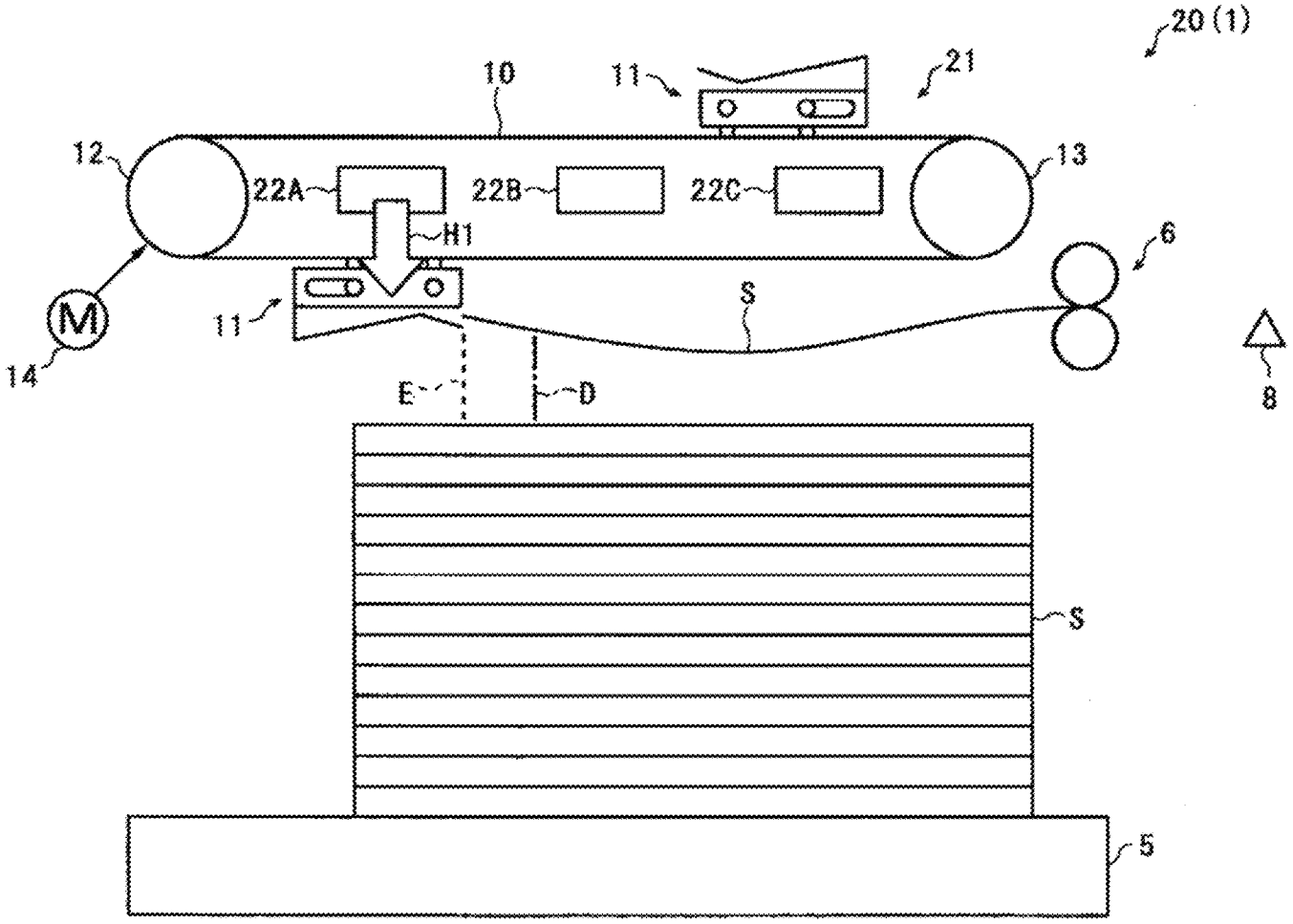
FIG. 10 is a schematic view illustrating an example of the sheet stacker according to the first embodiment of the present disclosure in a state where a transfer sheet is detached from a retaining member of the sheet stacker.

FIG. 10 illustrates an example of the sheet stacker according to the first embodiment of the present disclosure. In FIG. 10, the sheet stacker 20 has the same structure to the above-described sheet stacker 3, including that the sheet stacker 20 constitutes the image forming apparatus 1 together with the image forming mechanism 2, except that a guiding member 21 is used instead of the guiding member 7.

The guiding member 21 is structurally identical to the guiding member 7, except that blower fans 22A, 22B, and 22C, as a plurality of blowers (three blowers in the first embodiment) aligned parallel along the sheet-transporting direction A, are used instead of the single blower fan 15, and a controller 23 is used instead of the controller 16.

Each of the blower fans 22A, 22B, and 22C outputs a variable air volume. The blower fan 22A is disposed in a position corresponding to the detaching position E where a transported transfer sheet S is detached from a retaining member 11. In the present embodiment, the position is a position slightly downstream of the detaching position E in the sheet-transporting direction A.

Figure 11:
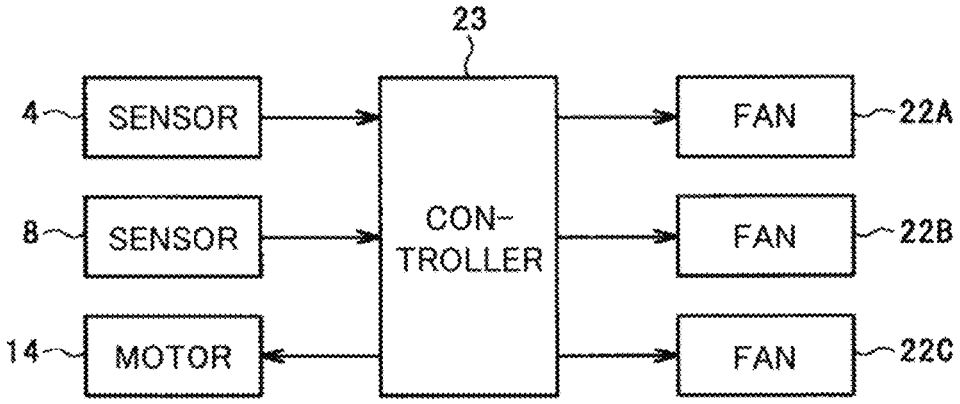
FIG. 11 is a block diagram depicting an example of a controller used for the sheet stacker according to the first embodiment of the present disclosure.

FIG. 11 is a block diagram depicting an example of the controller 23 that controls motions of the sheet stacker 20. The controller 23 including a microcomputer available in the related art receives input signals or input information from a sheet-size detection sensor 4, a sheet-edge detection sensor 8, and other sensors, and controls motions of various actuators in the sheet stacker 20, such as a motor 14, and the blower fans 22A, 22B, and 22C.

Next, a sheet transporting process of the sheet stacker 20 according to the first embodiment of the present disclosure will be described.

Similar to the sheet stacker 3, the sheet stacker 20 acquires information regarding a length of a transfer sheet S to be transported and stacked from size information of the transfer sheet detected by the sheet-size detection sensor 4 or size information of the transfer sheet S input to the image forming mechanism 2. Next, the transporting member 6 is driven together with driving of the image forming mechanism 2 to start transporting a transfer sheet S. At the time when the transporting of the transfer sheet S is started, the retaining member 11 of the guiding member 21 is stopped in the above-described standby position.

As the transporting of the transfer sheet S is started, the controller 23 operates only the blower fan 22A among the blower fans 22A, 22B, and 22C. At the time when the transporting of the transfer sheet S is started, the controller 23 acquires information regarding a length of the transfer sheet S from size information of the transfer sheet S to be transported, and controls motions of the blower fan 22A to discharge an air volume H1 based on the acquired information regarding the length. As the air volume H1 of the blower fan 22A, several air volumes are set in advance based on the information regarding the length of the transfer sheet S, specifically, the size, the basis weight, etc. of the transfer sheet S. The controller 23 selects and sets the air volume H1 optimal for the transfer sheet S to be transported among the several air volumes.

Then, when the sheet-edge detection sensor 8 detects an edge of the transfer sheet S, the first scheduled time, which has been set in advance similar to the above, is measured. Once the first scheduled time passes, the conveyor belt 10 starts to move, thereby starting moving the retaining member 11, which is stopped in the standby position, in the sheet-transporting direction A. At the time when the retaining member 11 starts moving, the edge portion of the transfer sheet S enters the retaining member 11 from the opening 11*a* to be retained with the catching member 11*b*.

Then, the edge of the transfer sheet S enters the retaining member 11 until the second scheduled time passes in a similar manner to the above. Once the second scheduled time passes, the amount of the edge portion of the transfer sheet S entering into the retaining member 11 reaches the predetermined amount C.

Once the amount of the entered edge portion of the transfer sheet S into the retaining member 11 reaches the predetermined amount C, the first acceleration of the retaining member 11 is carried out and the third scheduled time is measured, thereby transporting the transfer sheet S with the transporting member 6 and the guiding member 21. During the transporting of the transfer sheet S, the transfer sheet S is transported while pulling the edge portion of the transfer sheet S with the retaining member 11, thereby reducing flexure of the transfer sheet S.

As the third scheduled time passes after the retaining member 11 retains the transfer sheet S, the second acceleration of the retaining member 11 is carried out in an acceleration position D illustrated in FIG. 10, and the transfer sheet S is detached from the retaining member 11 in a detaching position E illustrated in FIG. 10. The transfer sheet S, whose edge portion is detached from the retaining member 11 and whose rear edge portion is released from the transporting member 6, starts to free fall, and receives the force of wind from the blower fan 22A to travel towards the sheet tray 5.

During the falling of the transfer sheet S, the air volume H1 of the blower fan 22A is set at an air volume optimal for the size and basis weight of the transported transfer sheet S. Therefore, the falling transfer sheet S is accurately landed on the sheet tray 5, thereby minimizing a misalignment of the stacking position of the transfer sheet S on the sheet tray 5. Since the air volume H1 of the blower fan 22A during the transporting of the transfer sheet S is set at an appropriate volume, dropping of the transfer sheet S from the retaining member 11 before the transfer sheet S reaches the detaching position E may be avoided by the force of wind from the blower fan 22A.

As described above, the first embodiment of the present disclosure can provide the sheet stacker 20 that can minimize dropping of the transfer sheet S during transporting regardless of the size of the sheet.

Figure 12:
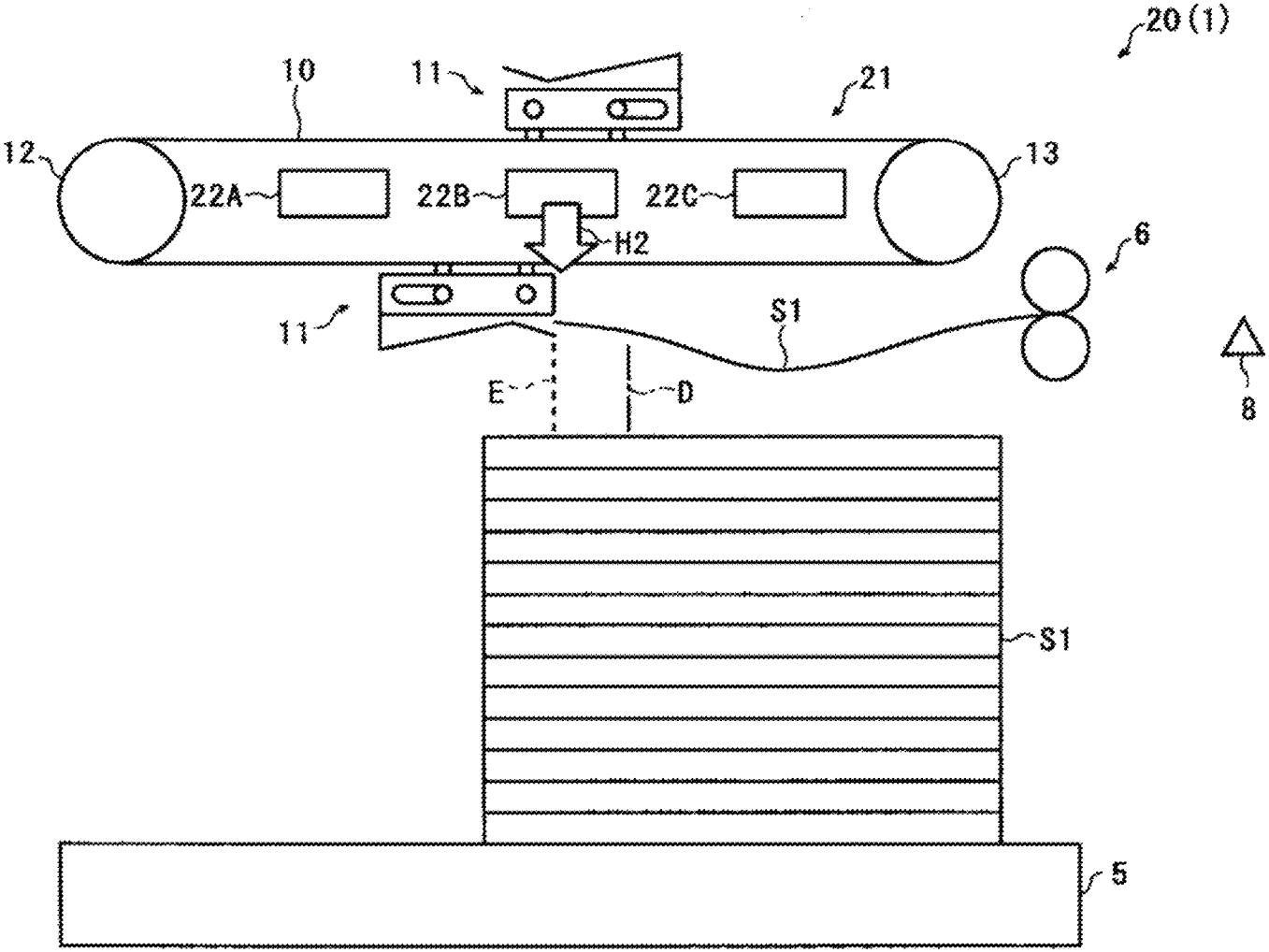
FIG. 12 is a schematic view illustrating an example of the sheet stacker according to the first embodiment of the present disclosure in a state where a small-size transfer sheet is detached from the retaining member of the sheet stacker.

FIG. 12 illustrates an example where a small-size transfer sheet S1, which is smaller than the transfer sheet S, is used instead of the transfer sheet S in the first embodiment. In the structure illustrated in FIG. 12, only the blower fan 22B is used when a small-size transfer sheet S1 is transported, and the blower fan 22B is disposed in a position corresponding to the detaching position E at which the transported small-size transfer sheet S1 is detached from the retaining member 11. In the present embodiment, the position is a position slightly upstream of the detaching position E in the sheet-transporting direction A. The air volume H2 of the blower fan 22B is set at an optimal air volume for the transported small-size transfer sheet S1 by the controller 23.

Similar to the above, the small-size transfer sheet S1 detached from the retaining member 11 in the detaching position E receives the optimal force of wind from the blower fan 22B to travel towards the sheet tray 5. Because of the above-described structure, the functions and effects similar to the first embodiment can be obtained.

Figure 13:
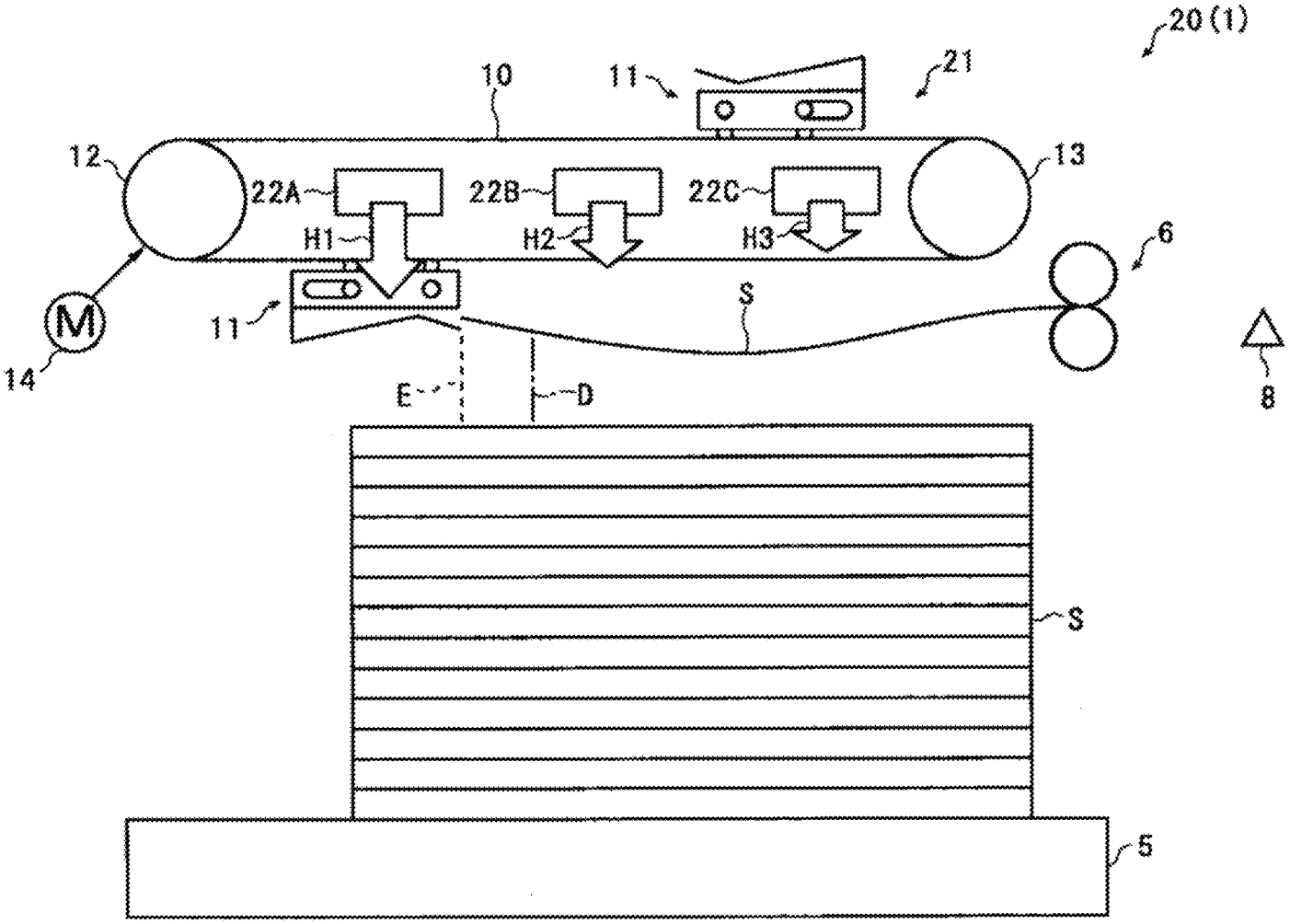
FIG. 13 is a schematic view illustrating an example of the sheet stacker according to the second embodiment of the present disclosure in a state where a transfer sheet is detached from a retaining member of the sheet stacker.

FIG. 13 illustrates an example according to the second embodiment of the present disclosure. The second embodiment has the same structure to the first embodiment, except that in addition to the blower fan 22A, the blower fans 22B and 22C are driven at the time when the transfer sheet S is transported.

Once transporting of a transfer sheet S is started, the controller 23 operates all of the blower fans 22A, 22B, and 22C. Similar to the first embodiment, the controller 23 controls motions of the blower fan 22A to discharge the air volume H1 based on information regarding a length of the transported transfer sheet S, and controls motions of the blower fans 22B and 22C to discharge an air volume H2 from the blower fan 22B and an air volume H3 from the blower fan 22C.

Figure 14:
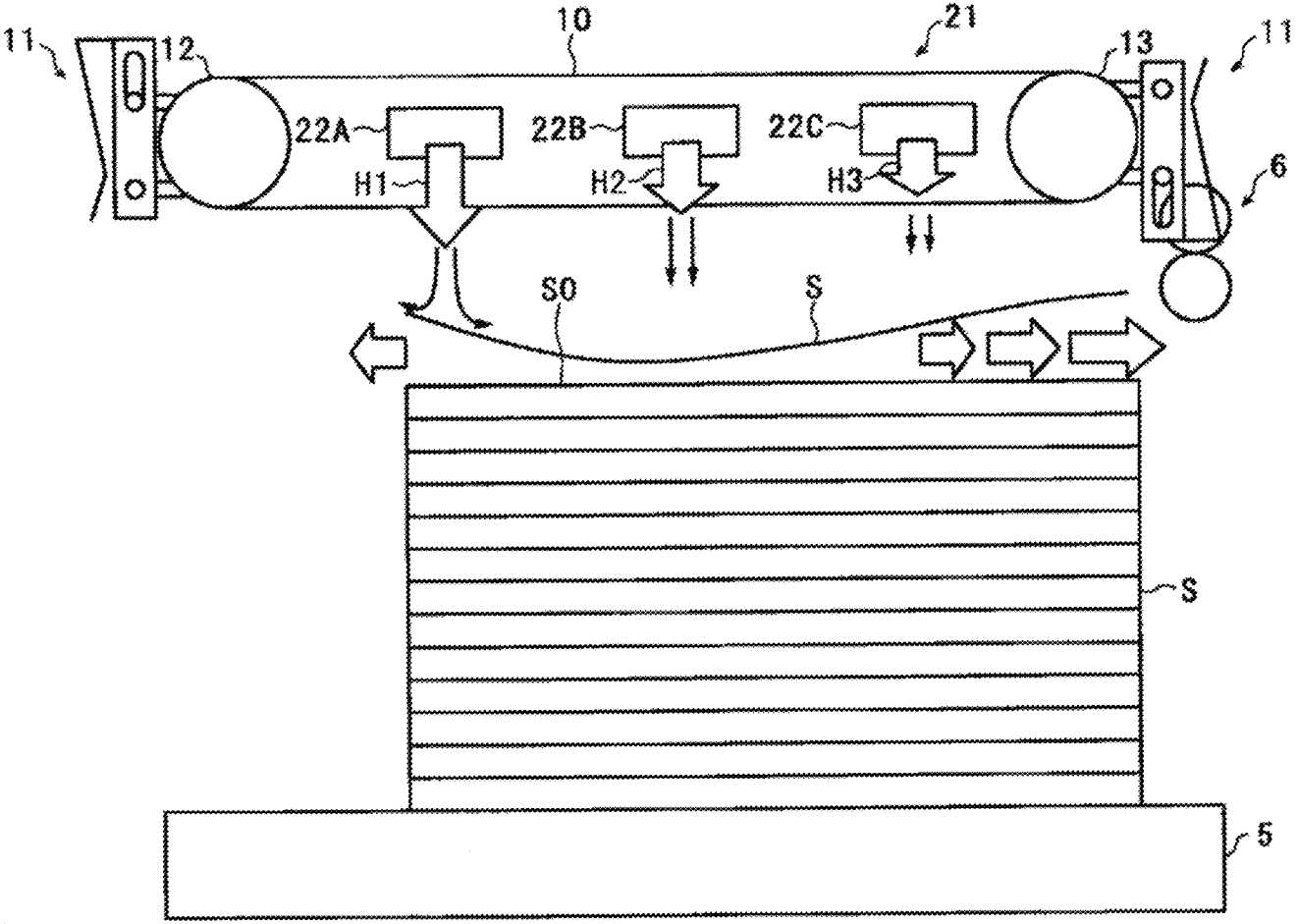
FIG. 14 is a schematic view illustrating a movement of a transfer sheet detached from and falling from the retaining member of the sheet stacker according to the second embodiment of the present disclosure.

The transfer sheet S detached from the retaining member 11 to fall onto the sheet tray 5 is desirably stacked in a manner that the center portion of the transfer sheet S comes into contact with the top sheet S0 first, followed by allowing both edges of the transfer sheet S to come into contact with the top sheet S0, as illustrated in FIG. 14. The top sheet S0 is the uppermost sheet among the transfer sheets S stacked on the sheet tray 5. Since the transfer sheet S is stacked in the above-described manner, air is released from the space between the top sheet S0 and the falling transfer sheet S as indicated with thick arrows in FIG. 14. Therefore, the transfer sheet S, which is positioned above the top sheet S0, does not slide over the top sheet S0, which is positioned below the transfer sheet S, which could be caused due to the air layer created with the air having entered between the sheets S and S0, thereby minimizing a misalignment of the stacking position of the transfer sheet S due to sliding of the transfer sheet S.

In the second embodiment, the controller 23 controls motions of the blower fans 22A, 22B, and 22C to discharge air volumes H1, H2, and H3, respectively. With the air volumes H1, H2, and H3, the transfer sheet S, which is detached from the retaining member 11 to fall onto the sheet tray 5, behaves as illustrated in FIG. 14. Specifically, the air volumes H1, H2, and H3 are respectively set at air volumes optimal for the size and basis weight of the transported transfer sheet S, and are set in a manner such that the air volume H2 is smaller than the air volume H1, and the air volume H3 is smaller than the air volume H2.

Because of the above-described structure, the air is efficiently released from the space between the top sheet S0 and the falling transfer sheet S to minimize a misalignment of the stacking position caused by the air having entered between the sheets.

Figure 15:
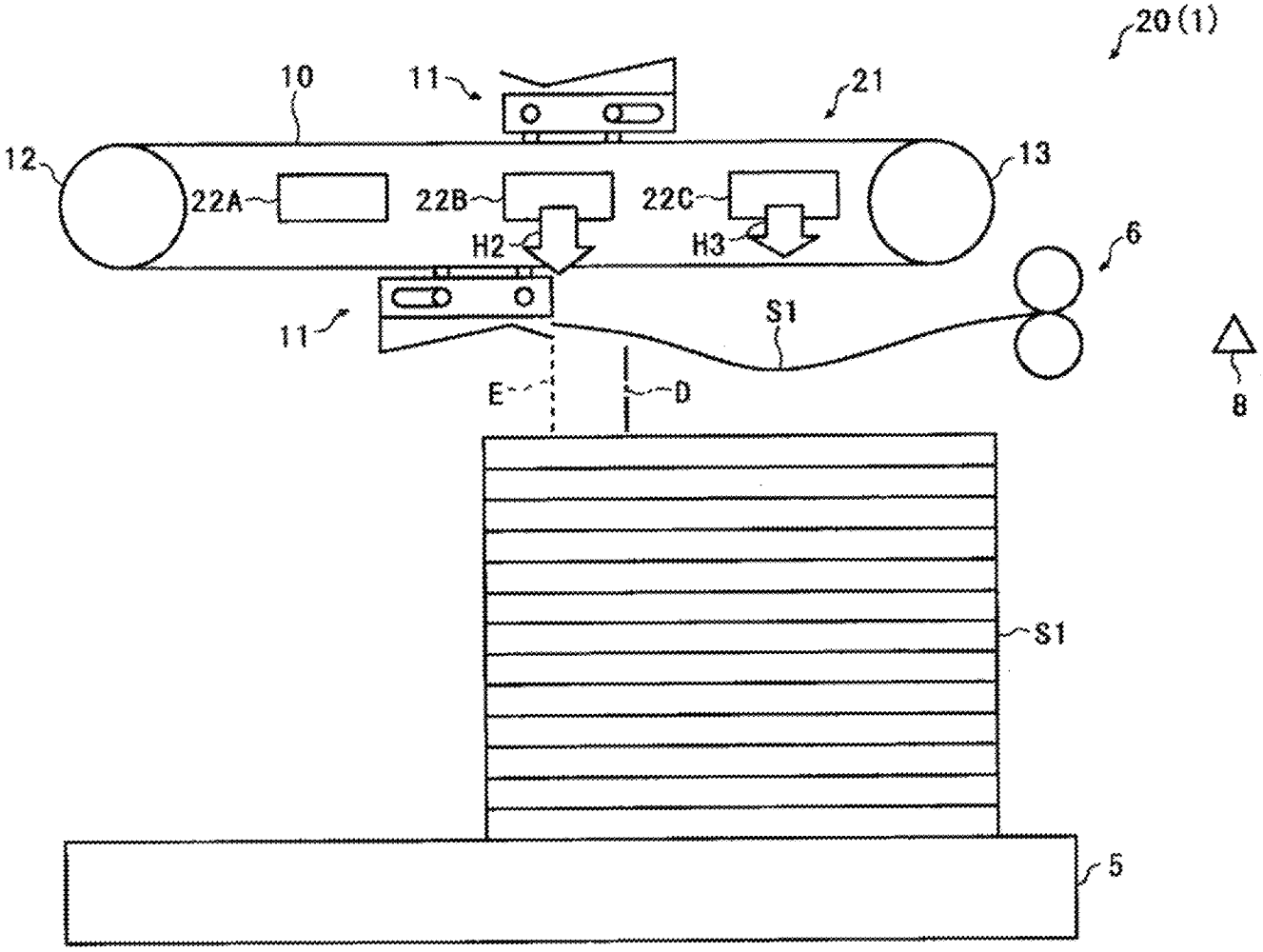
FIG. 15 is a schematic view illustrating an example of the sheet stacker according to the second embodiment of the present disclosure in a state where a small-size transfer sheet is detached from the retaining member of the sheet stacker.

FIG. 15 illustrates an example where a small-size transfer sheet S1 is used instead of the transfer sheet S in the second embodiment. In the structure illustrated in FIG. 15, the blower fans 22B and 22C are used when the small-size transfer sheet S1 is transported, and the blower fan 22B is disposed in the position corresponding to the detaching position E at which the transported small-size transfer sheet S1 is detached from the retaining member 11. In the present embodiment, the position is a position slightly upstream of the detaching position E in the sheet-transporting direction A. The air volume H2 of the blower fan 22B and the air volume H3 of the blower fan 22C are set at air volumes optimal for the transported small-size transfer sheet S1 by the controller 23.

Similar to the above, the small-size transfer sheet S1 detached from the retaining member 11 in the detaching position E receives the optimal force of wind from the blower fans 22B and 22C to travel towards the sheet tray 5. Because of the above-described structure, the functions and effects similar to the second embodiment can be obtained.

In the first and second embodiments, the blower fan 22A is not used among the blower fans 22A, 22B, and 22C when the a small-size transfer sheet S1 is used as a transfer sheet transported by the sheet stacker 20, as illustrated in FIGS. 12 and 15. Specifically, the above-described structure is a structure in which, among the blowers 22A, 22B, and 22C, the blower fan 22A disposed outside the stacking range is not operated. The stacking range is a range in which the small-size transfer sheet S1 is stacked in the sheet tray 5.

Because of the above-described structure, disturbance of the air flows can be minimized regardless of the size of the transfer sheet to be stacked, the air in the space between the falling sheet and the top sheet on the stacked sheets can be efficiently released, thereby reducing a misalignment of the stacking position of the transfer sheet due to the air having entered between the sheets.

Figure 16:
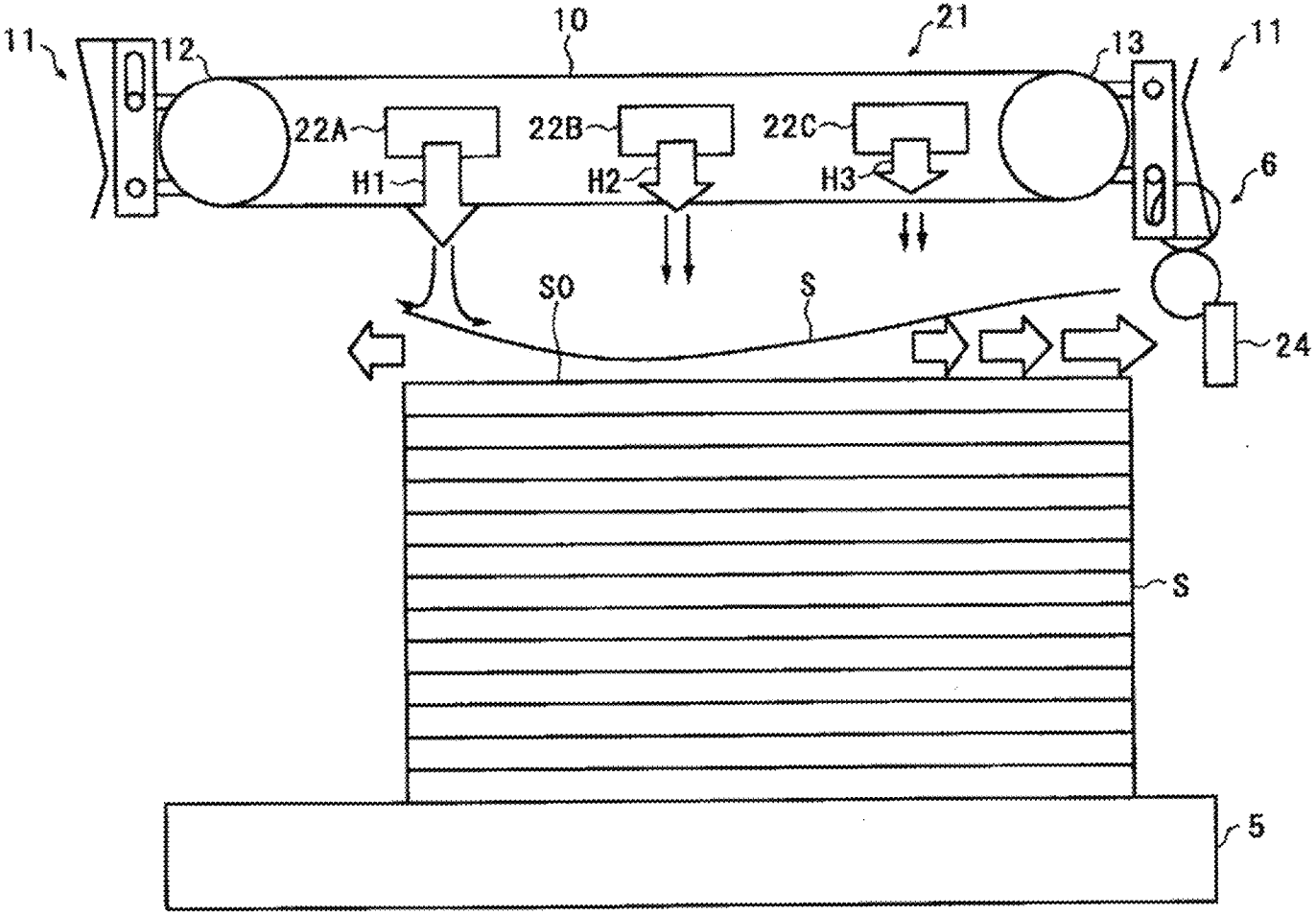
FIG. 16 is a schematic view for describing a movement of a transfer sheet detached from the retaining member of the sheet stacker according to the third embodiment of the present disclosure.

FIG. 16 illustrates an example according to the third embodiment of the present disclosure. The third embodiment has the same structure to the second embodiment, except that a suction fan 24 is provided as a suction member, and the suction fan 24 is driven during transporting of the transfer sheet S.

The controller 23 operates the suction fan 24 in addition to all of the blower fans 22A, 22B, and 22C when transporting of the transfer sheet S is started. When the suction fan 24 is driven, the controller 23 controls motions of the suction fan 24 to achieve a suction amount determined based on information regarding a length of the transported transfer sheet S.

Because of the above-described structure, disturbance of the air flows can be minimized regardless of the size of the transfer sheet to be stacked, the air in the space between the falling sheet and the top sheet on the stacked sheets can be efficiently released, thereby minimizing a misalignment of the stacking position of the transfer sheet due to the air having entered between the sheets. Note that, a plurality of the suction fans 24 may be disposed along the sheet-width direction B.

In first or third embodiment, the sheet stacker is configured to determine the predetermined amount C of the edge portion of the transfer sheet S entering the retaining member 11 based on the first scheduled time and the second scheduled time, when the guiding member 21 starts transporting the transfer sheet S. As a predetermined amount C is larger, the edge portion of the transfer sheet S is more unlikely to drop from the retaining member 11. However, the larger predetermined amount C may affect a transported state of a transfer sheet S, such as a reduction in a flexure amount of the sheet when the sheet size is small, because the position for supporting the edge portion of the transfer sheet S is shifted towards the downstream side in the sheet-transporting direction A.

Therefore, the predetermined amount C is set based on the information regarding the length of the transfer sheet S transported, i.e., information of a size, a basis weight, etc. of the transfer sheet S, so that the desired state of the transfer sheet S can be retained during the transporting and transporting failures due to dropping of the transfer sheet S can be minimized.

In the first or third embodiment, an edge of a sequential transfer sheet S2 (see FIG. 9) is detected by the sheet-edge detection sensor 8, similar to the transfer sheet S. The sequential transfer sheet S2 is sequentially transported following the transfer sheet S that is detached from the retaining member 11 in the detaching position E. The sequential transfer sheet S2 is transported and stacked in the same manner as transporting and stacking of the transfer sheet S. The faster the timing for returning the retaining member 11 back to the standby position is, the faster the timing for receiving the transfer sheet S2 is. Therefore, the sheet stacker capable of increasing the sheet-transporting speed can be provided. Therefore, timings for driving the image forming mechanism 2 and the transporting member 6 can be set early so that the efficiency of the image formation can be improved owing to an accelerated image formation process. However, in the case where the falling amount G of the transfer sheet S is small, if the timing for returning the retaining member 11 back to the standby position is too early, as illustrated in FIG. 9, the falling transfer sheet S may collide with the retaining member 11 to misalign the stacking position of the transfer sheet S.

Therefore, the controller 23 controls the timing of the retaining member 11 reaching the standby position based on information from the sheet-edge detection sensor 8 in a manner such that the retaining member 11 reaches the standby position just before entering of a sequential transfer sheet S2 into the transfer sheet S2. The sheet-edge detection sensor 8 detects an edge portion of the sequential transfer sheet S2. Specifically, the position of the retaining member 11 is determined based on the step number of the motor 14, and the timing of the retaining member 11 reaching the standby position is controlled by varying rotations of the motor 14. Here, the sheet-edge detection sensor 8 functions as a retention timing detector.

According to the above-described structure, a falling time for the transfer sheet S to be detached from the retaining member 11 in the detaching position E and to fall can be secured, thereby providing a sheet stacker that can minimize problems, such as a collision between the falling transfer sheet S and the retaining member 11, and can increase the sheet-transporting speed, as well as minimizing a misalignment of the stacking position of the transfer sheet S.

In the above-described structure, a collision between the falling transfer sheet S and the retaining member 11 can be avoided based on the edge position of the sequential transfer sheet S2 and the position of the retaining member 11. When a falling speed of a transfer sheet S is slow, the falling transfer sheet S may collide with a retaining member 11 regardless of an edge position of a sequential transfer sheet S2. A structure for avoiding the above-described problem will be described as a fourth embodiment hereinafter.

Figure 17:
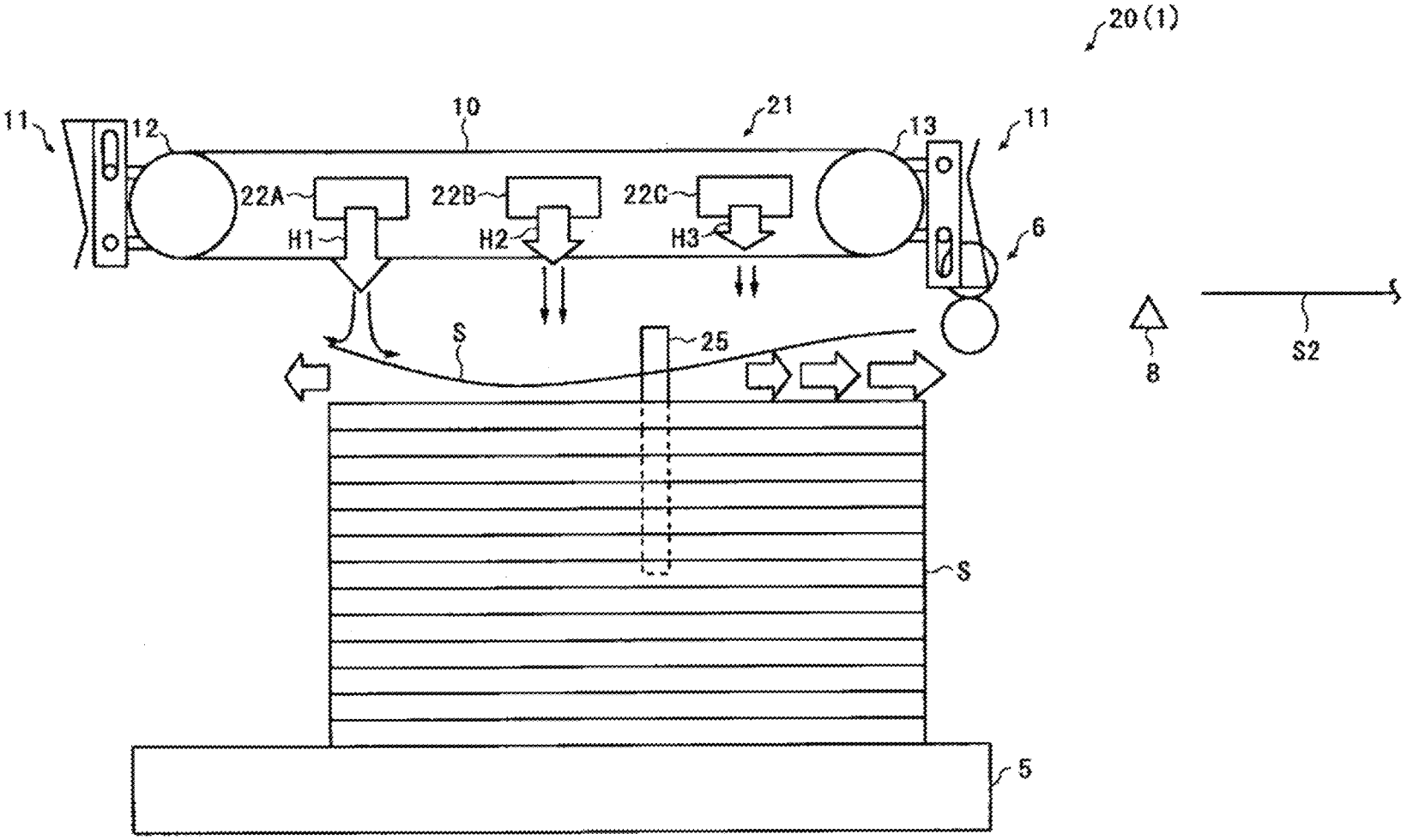
FIG. 17 is a schematic view for describing a movement of a transfer sheet detached from the retaining member of the sheet stacker according to the fourth embodiment of the present disclosure.

FIG. 17 illustrates an example according to the fourth embodiment of the present disclosure. The fourth embodiment has the same structure to the second embodiment, except that a falling-sheet detection sensor 25 is provided as a sheet-height detector, and a position of the transfer sheet S during falling is detected. The falling-sheet detection sensor 25 is longitudinally formed along the vertical direction. The falling-sheet detection sensor 25 successively detects a falling position, and outputs the detected signals to the controller 23. The falling position is a height position of a transfer sheet S that is detached from the retaining member 11 in the detaching position E and is falling. The controller 23 stores a correlation between a falling time and falling position (height position) of the transfer sheet S having fallen from the retaining member 11 in the detaching position E, as standard values of a falling time and falling position (height position) relative to information regarding a length of a transfer sheet S, specifically, per size and basis weight of the transfer sheet S. The stored correlation is determined by experiments in advance.

In the fourth embodiment, the falling-sheet detection sensor 25 detects the position of the transfer sheet S during falling of the transfer sheet S from the time when the transfer sheet S is detached from the retaining member 11 in the detaching position E. When the falling position, which is the height position of the falling transfer sheet S, detected by the falling-sheet detection sensor 25 is lower than the standard value stored in the controller 23, the controller 23 judges that the position of the falling transfer sheet S is lower than a height position in the regular operation. In the above-described case, the controller 23 is configured to reduce an air volume of each of the blower fans 22B and 22C, which largely affects the falling transfer sheet S. Therefore, the desired state of the transfer sheet S during transporting can be retained, thereby minimizing transporting failures due to dropping of the transfer sheet S.

In the fourth embodiment, when the position of the falling transfer sheet S detected by the falling-sheet detection sensor 25 is higher than the standard value stored in the controller 23, the controller 23 is configured to increase an air volume of each of the blower fans 22B and 22C, which largely affects the falling transfer sheet S. Therefore, the desired state of the transfer sheet S during transporting can be retained, thereby minimizing transporting failures due to dropping of the transfer sheet S. Moreover, a collision between the transfer sheet S and the retaining member 11 caused by the slow falling of the transfer sheet S can be avoided, thereby minimizing a misalignment of the stacking position of the transfer sheet S.

In fourth embodiment, when the falling position (height position) of the transfer sheet S during falling detected by the falling-sheet detection sensor 25 is lower than the standard value stored in the controller 23, the controller 23 is configured to control motions of the transporting member 6 and the motor 14 to adjust the predetermined value C to be larger than the predetermined value C used when the falling position is equal to the standard value. According to the above-described structure, the flexure amount of the transfer sheet S during falling is reduced compared to the case of the standard value. Therefore, air resistance is increased so that the desired state of the transfer sheet S during transporting can be retained, and transporting failures due to dropping of the transfer sheet S can be minimized.

Moreover, when the falling position (height position) of the transfer sheet S during falling detected by the falling-sheet detection sensor 25 is higher than the standard value stored in the controller 23, the determined amount C is controlled to be smaller than the predetermined value C used when the falling position is equal to the standard value, thereby obtaining the same functions and effects to the above.

Next, the fifth embodiment of the present disclosure will be described. In the fifth embodiment, the detected information by the falling-sheet detection sensor 25, namely, the position information of the transfer sheet S during falling and the air volumes of the blower fans 22A, 22B, and 22C for the falling transfer sheet S, and weight information regarding the size and basis weight of the transported transfer sheet S are linked in the same structure to the fourth embodiment. The linked position information, air volumes, and weight information are stored as the air volume data in the controller 23, and the stored air volume data is sequentially accumulated as the data increases. In the case where the transfer sheet S having a weight equal to a weight of a transfer sheet S that has been previously transported is transported again, namely in the case where information regarding a weight of the transported transfer sheet S is matched with the weight information accumulated in the air volume data, transporting and stacking of the transfer sheet S are carried out using the accumulated air volume data.

According to the fifth embodiment, optimal transporting and stacking of a transfer sheet S can be performed by reading the stored data, control can be simplified, and optimal transporting and stacking are performed constantly.

In the fifth embodiment, the position information of the transfer sheet S during falling, an air volume of each of the blower fans 22A, 22B, and 22C for the falling transfer sheet are liked with information regarding a weight of the transported transfer sheet S. However, the sheet stacker may have a structure where the position information of the transfer sheet S during falling and the predetermined amount C of the edge portion of the transfer sheet S are linked with information regarding a weight of the transfer sheet S to be transported. The linked position information, predetermined amount C, and weight information are stored as data of the predetermined amount in the controller 23, and the stored data of the predetermined amount is sequentially accumulated as the data increases. When the weight information of the transported transfer sheet S is matched with the weight information in the accumulated air volume data, transporting and stacking of the transfer sheet S are performed using the accumulated data of the predetermined amount.

According to the above-described structure, the functions and effects similar to the fifth embodiment can be obtained.

In the first or fifth embodiment described above, the example where the blower fans 22A, 22B, and 22C disposed along the sheet-transporting direction A are used as the blower has been described. However, the structure illustrated in FIG. 18 may be used instead of the structure of the first to fifth embodiments.

Figure 18:
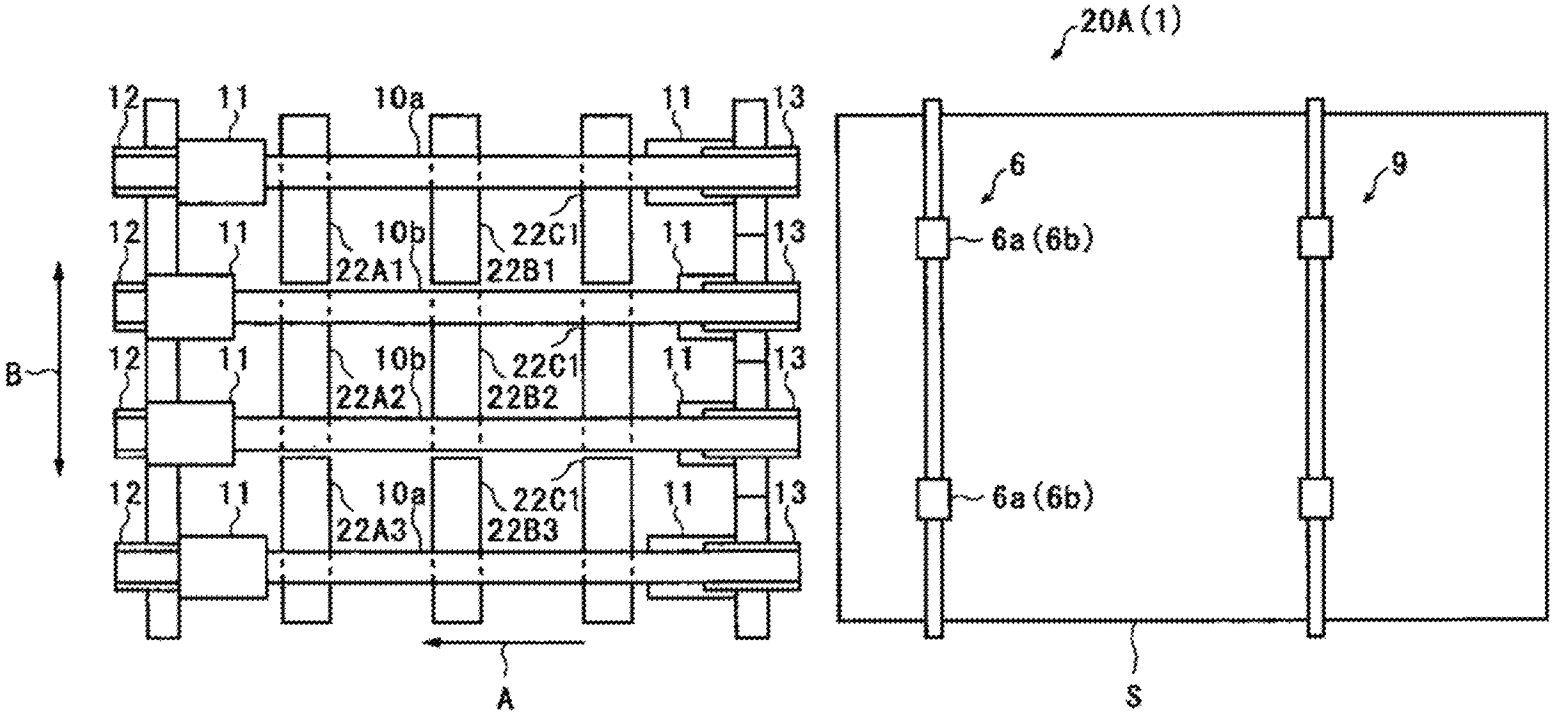
FIG. 18 is a schematic plan view illustrating an example of the sheet stacker according to the sixth embodiment of the present disclosure.

FIG. 18 illustrates a schematic plan view illustrating an example of a sheet stacker 20A according to the sixth embodiment of the present disclosure. The sheet stacker 20A has the same structure to the sheet stacker 20, except that blower fans 22A1, 22A2, 22A3, 22B1, 22B2, 22B3, 22C1, 22C2, and 22C3 are used instead of the blower fans 22A, 22B, and 22C. The blower fans 22A1, 22A2, and 22A3 are designed to divide the blower fan 22A into three fans in the sheet-width direction B. The blower fans 22B1, 22B2, and 22B3, and the blower fans 22C1, 22C2, and 22C3 are designed in the similar manner.

In the sixth embodiment, the blower fans 22A, 22A2, and 22A3 are operated and controlled in the same manner as the blower fan 22A; the blower fans 22B1, 22B2, and 22B3 are operated and controlled in the same manner as the blower fan 22B; the blower fans 22C1, 22C2, and 22C3 are operated and controlled in the same manner as the blower fan 22C. The sheet stacker 20A acquires the length information and width information of the transfer sheet S, which is transported and stacked, from the size information of the transfer sheet S detected from the sheet-size detection sensor 4 or the size information of the transfer sheet S input into the image forming mechanism 2. The acquired information is input to the controller 23, and the controller 23 controls motions of each of the blower fans arranged along the sheet-width direction B based on the input width information of the transfer sheet S.

Because of the above-described structure, the air volume can be precisely controlled in the sheet-width direction B by each of the blower fans compared to the first or fifth embodiment, and the functions and effects similar to the above-described embodiment can be obtained even when a transfer sheet S with which flexure, twisting, etc. occur in the sheet-width direction B is transported.

In each of the above-described embodiments, once driving of the transporting member 6 is started to start transporting a transfer sheet S, the controller 23 controls to drive each of the blower fans 22A, 22B, and 22C. The timing for driving each of the blower fans 22A, 22B, and 22C may be set in a manner such that each of the blower fans 22A, 22B, and 22C is actuated at the time when the edge portion of the transfer sheet S is detached from the retaining member 11 in the detaching position E. The controller 23 judges whether the retaining member 11 reaches the detaching position E based on the step number of the motor 14. According to the above-described structure, the same functions and effects to the above can be also obtained. In addition, motions of the blower can be minimized so that a reduction in the running cost and a reduction in noise of the driven blower fans can be achieved.

The above embodiments describe the examples where the inkjet recording apparatus for forming full-color images is used as the image forming apparatus to which the present disclosure is applied. However, the image forming apparatus to which the present disclosure can be applied is not limited to the above-described examples. The present disclosure can be applied to copiers, facsimiles, multifunction peripherals, etc.

Moreover, the above embodiments describe the structure where the transfer sheets S are used as sheets of recording media on which image formation is performed. The transfer sheets S are not limited to recording paper, and may include cardboard, postcards, paper rolls, envelops, plain paper, tissue paper, coated paper (e.g., coat paper and art paper), tracing paper, OHP sheets, OHP films, and resin films. Any of sheet-shaped hygroscopic materials to which image formation can be performed may be used as the transfer sheets S.

The present disclosure provides sheet stackers capable of minimizing dropping of sheets during transporting regardless of a size of sheets, and sheet stackers capable of minimizing misalignments of the sheet stacking positions and increasing sheet-transporting speed.

For example, embodiments of the present disclosure are as follows.

[1] A sheet stacker includes a stacking member, a transporting member, a guiding member, a plurality of blowers, and a controller. A sheet is stacked on the stacking member. The transporting member transports the sheet in a sheet-transporting direction towards the stacking member. The guiding member retains an edge portion of the sheet, which is transported by the transporting member, in a standby position, followed by moving in the sheet-transporting direction to guide transporting of the sheet. The edge portion of the sheet retained by the guiding member is detached from the guiding member in a detaching position using a difference between a sheet-transporting speed of the transporting member and a traveling speed of the guiding member. The detached sheet is allowed to fall and to be stacked on the stacking member. The plurality of the blowers discharge air flows towards the sheet that is transported to the stacking member. The air flows are directed towards a top plane of the stacking member. One of the plurality of the blowers is disposed in a position corresponding to the detaching position. The controller controls motions of the plurality of the blowers and air volumes from the plurality of the blowers based on information regarding a length of the transported sheet.

[2] The sheet stacker according to [1], in which the controller is configured to operate, among the plurality of the blowers, the blower disposed in the position corresponding to the detaching position before or at a time when the edge portion of the sheet is detached from the guiding member.

[3] The sheet stacker according to [2], in which the controller is configured to operate, among the plurality of the blowers, the blower or blowers disposed upstream of the blower disposed in the position corresponding to the detaching position in the sheet-transporting direction, and controls the plurality of the blowers to gradually reduce the air volumes of the plurality of the blowers from upstream to downstream in the sheet-transporting direction before or at a time when the edge portion of the sheet is detached from the guiding member.

[4] The sheet stacker according to any one of [1] to [3], in which the controller allows, among the plurality of the blowers, the blower or blowers disposed outside a stacking range to stand idle, and the stacking range is a range in which the sheet is stacked on the stacking member.

[5] The sheet stacker according to any one of [1] to [4], in which the sheet stacker further includes a suction member. The suction member suctions air between sheets to be stacked on the stacking member. The controller controls motions of the suction member based on the information regarding the length of the transported sheet.

[6] The sheet stacker according to any one of [1] to [5], in which the guiding member includes a retaining member. The retaining member retains the edge portion of the sheet entering the guiding member. The controller is configured to start moving the guiding member to transfer the sheet when a predetermined amount of the edge portion of the sheet enters the retaining member, where the predetermined amount of the edge portion of the sheet is set based on the information regarding the length of the sheet.

[7] The sheet stacker according to any one of [1] to [6], in which the sheet stacker further includes a retention timing detector. The retention timing detector detects an edge portion of a sequentially transported sheet following the sheet detached from the guiding member in the detaching position. A timing of the guiding member reaching the standby position is controlled to be just before a time when the sequentially transported sheet is retained by the guiding member based on information from the retention timing detector.

[8] The sheet stacker according to any one of [1] to [7], in which the sheet stacker further includes a sheet-height detector. The sheet-height detector detects a position of the sheet during falling as a height position of the sheet falling in a stacking range that is a range in which the sheet is stacked on the stacking member. When the detected height position of the falling sheet is lower than a standard value stored in the controller, the controller controls, among the plurality of the blowers, the blower or blowers disposed upstream of the blower disposed in the position corresponding to the detaching position in the sheet-transporting direction to discharge a smaller air volume than an air volume discharged when a height position of the falling sheet is equal to the standard value.

[9] The sheet stacker according to [6], in which the sheet stacker further includes a sheet-height detector. The sheet-height detector detects a position of the sheet during falling as a height position of the sheet falling in a stacking range that is a range in which the sheet is stacked on the stacking member. When the detected height position of the falling sheet is lower than a standard value stored in the controller, the predetermined amount of the edge portion of the sheet is controlled to be larger than the predetermined amount of the edge portion of the sheet used when a height position of the falling sheet is equal to the standard value.

[10] The sheet stacker according to any one of [1] to [8], in which the sheet stacker further includes a sheet-height detector. The sheet-height detector detects a position of the sheet during falling as a height position of the sheet falling in a stacking range that is a range in which the sheet is stacked on the stacking member. When the height position of the falling sheet is higher than a standard value stored in the controller, the controller controls, among the plurality of the blowers, the blower or blowers disposed upstream of the blower disposed in the position corresponding to the detaching position in the sheet-transporting direction to discharge a larger air volume than an air volume discharged when a height position of the falling sheet is equal to the standard value.

[11] The sheet stacker according to [6], in which the sheet stacker further includes a sheet-height detector. The sheet-height detector detects a position of the sheet during falling as a height position of the sheet falling in a stacking range that is a range in which the sheet is stacked on the stacking member. When the height position of the falling sheet is higher than a standard value stored in the controller, the predetermined amount of the edge portion of the sheet is controlled to be smaller than the predetermined amount of the edge portion of the sheet used when a height position of the falling sheet is equal to the standard value.

[12] The sheet stacker according to [9], in which when the height position of the falling sheet is higher than a standard value stored in the controller, the predetermined amount of the edge portion of the sheet is controlled to be smaller than the predetermined amount of the edge portion of the sheet used when a height position of the falling sheet is equal to the standard value.

[13] The sheet stacker according to [8] or [10], in which detection information of the sheet-height detector and the air volume of the blower when the height position is detected are linked with information regarding a weight of the transported sheet, in addition to sequentially accumulating the linked information as air volume data. The accumulated air volume data is used when the sheet that has a weight equal to a weight of a previously transported sheet is transported.

[14] The sheet stacker according to [9], [11], or [12], in which detection information of the sheet-height detector and the predetermined amount of the edge portion of the sheet when the height position is detected are linked with information regarding a weight of the transported sheet. In addition, the linked information is sequentially accumulated as data of the predetermined amount. The accumulated data of the predetermined amount is used when the sheet that has a weight equal to a weight of a previously transported sheet is transported.

[15] The sheet stacker according to any one of [1] to [14], in which the plurality of the blowers are arranged along a sheet-width direction orthogonal to the sheet-transporting direction. The controller controls motions of the plurality of the blowers and air volumes of the plurality of the blowers based on the information regarding the length of the transported sheet and information regarding a width of the transported sheet.

[16] An image forming apparatus includes an image forming mechanism and the sheet stacker according to any one of [1] to [15].

The preferred embodiments of the present disclosure have been described above, but the present disclosure shall not be construed as being limited to these embodiment. Various modifications and variations may be made without departing from the scope of the present disclosure, unless otherwise stated.

The effects described in the embodiments of the present disclosure are merely examples of the most suitable examples obtainable by the present disclosure. The effects of the present disclosure are not limited to the effects described in the embodiments of the present disclosure.

What is claimed is:

1. A sheet stacker, comprising:

a tray on which a sheet is stacked;

a transporter that transports the sheet in a sheet-transporting direction towards the tray;

a guide that retains an edge portion of the sheet transported by the transporter in a standby position, followed by moving in the sheet-transporting direction to guide transporting of the sheet, the edge portion of the sheet retained by the guide being detached from the guide in a detaching position using a difference between a sheet-transporting speed of the transport and a traveling speed of the guide, the detached sheet being allowed to fall and to be stacked on the tray;

a plurality of blowers that discharge air flows towards the sheet transported to the tray, the air flows being directed towards a top plane of the tray, and a first blower of the plurality of the blowers being disposed at a first position corresponding to the detaching position; and a controller configured to control motion of the plurality of the blowers and air volume from the plurality of the blowers based on length information indicating a length of the transported sheet, operate, among the plurality of the blowers, the first blower before or at a time when the edge portion of the sheet is detached from the guide, operate, among the plurality of the blowers, one or more blowers disposed upstream of the first blower in the sheet-transporting direction, and control the plurality of the blowers to gradually reduce the air volume of the plurality of the blowers from upstream to downstream in the sheet-transporting direction before or at a time when the edge portion of the sheet is detached from the guide.

2. The sheet stacker according to claim 1, wherein the controller allows, among the plurality of the blowers, one or more blowers disposed outside a stacking range to stand idle, and the stacking range is a range in which the sheet is stacked on the tray.

3. The sheet stacker according to claim 1, further comprising:

a suction fan that suctions air between sheets to be stacked on the tray, wherein the controller controls motion of the suction fan based on the length information.

4. The sheet stacker according to claim 1, further comprising:

a retention timing detector that detects an edge portion of a sequentially transported sheet following the sheet detached from the guide in the detaching position, wherein the controller controls, based on information from the retention timing detector, the guide to reach the standby position at a timing just before the sequentially transported sheet is retained by the guide.

5. The sheet stacker according to claim 1, further comprising:

a sheet-height detector that detects a position of the sheet during falling as a height position of the sheet falling in a stacking range that is a range in which the sheet is stacked on the tray, wherein when the height position of the falling sheet is lower than a standard value, the controller controls, among the plurality of the blowers, the one or more blowers disposed upstream of the first blower in the sheet-transporting direction to discharge a smaller air volume than an air volume discharged when a height position of the falling sheet is equal to the standard value.

6. The sheet stacker according to claim 5, wherein detection information of the sheet-height detector and the air volume when the height position is detected are linked with weight information indicating a weight of the transported sheet, in addition to sequentially accumulating the linked information as air volume data, and accumulated air volume data is used when the sheet that has a weight equal to a weight of a previously transported sheet is transported.

7. The sheet stacker according to claim 5, wherein the standard value is of a falling position of a sheet stored together with a standard value of a falling time of the sheet, where the standard values of the falling time and falling position relative to the length information are determined in advance by experiments as a correlation between the falling time and falling position of the sheet having fallen from the guide in the detaching position.

8. The sheet stacker according to claim 1, further comprising:

a sheet-height detector that detects a position of the sheet during falling as a height position of the sheet falling in a stacking range that is a range in which the sheet is stacked on the tray, wherein when the height position of the falling sheet is higher than a standard value, the controller controls, among the plurality of the blowers, the one or more blowers disposed upstream of the first blower in the sheet-transporting direction to discharge a larger air volume than an air volume discharged when a height position of the falling sheet is equal to the standard value.

9. The sheet stacker according to claim 8, wherein the standard value is of a falling position of a sheet stored together with a standard value of a falling time of the sheet, where the standard values of the falling time and falling position relative to the length information are determined in advance by experiments as a correlation between the falling time and falling position of the sheet having fallen from the guide in the detaching position.

10. The sheet stacker according to claim 1, wherein the plurality of the blowers are arranged along a sheet-width direction orthogonal to the sheet-transporting direction, and the controller controls motion of the plurality of the blowers and air volume of the plurality of the blowers based on the length information and width information indicating a width of the transported sheet.

11. An image forming apparatus, comprising:

an image forming mechanism; and the sheet stacker according to claim 1.

12. A sheet stacker, comprising:

a tray on which a sheet is stacked;

a transporter that transports the sheet in a sheet-transporting direction towards the tray;

a guide that retains an edge portion of the sheet transported by the transporter in a standby position, followed by moving in the sheet-transporting direction to guide transporting of the sheet, the edge portion of the sheet retained by the guide being detached from the guide in a detaching position using a difference between a sheet-transporting speed of the transport and a traveling speed of the guide, the detached sheet being allowed to fall and to be stacked on the tray;

a plurality of blowers that discharge air flows towards the sheet transported to the tray, the air flows being directed towards a top plane of the tray, and a first blower of the plurality of the blowers being disposed at a first position corresponding to the detaching position; and a controller configured to control motion of the plurality of the blowers and air volume from the plurality of the blowers based on length information indicating a length of the transported sheet, wherein the guide includes a retaining member that retains the edge portion of the sheet entering the guide, the retaining member includes an opening, and the controller is further configured to start moving the guide to transfer the sheet when a predetermined amount of the edge portion of the sheet enters the retaining member, the predetermined amount being set based on the length information.

13. The sheet stacker according to claim 12, further comprising:

a sheet-height detector that detects a position of the sheet during falling as a height position of the sheet falling in a stacking range that is a range in which the sheet is stacked on the tray, wherein when the height position of the falling sheet is lower than a standard value, the predetermined amount of the edge portion of the sheet is controlled to be larger than the predetermined amount of the edge portion of the sheet used when a height position of the falling sheet is equal to the standard value.

14. The sheet stacker according to claim 13, wherein detection information of the sheet-height detector and the predetermined amount of the edge portion of the sheet when the height position is detected are linked with weight information indicating a weight of the transported sheet, in addition to sequentially accumulating the linked information as data of the predetermined amount, and accumulated data of the predetermined amount is used when the sheet that has a weight equal to a weight of a previously transported sheet is transported.

15. The sheet stacker according to claim 13, wherein the standard value is of a falling position of a sheet stored together with a standard value of a falling time of the sheet, where the stored standard values of the falling time and falling position relative to the length information are determined in advance by experiments as a correlation between the falling time and falling position of the sheet having fallen from the guide in the detaching position.

16. The sheet stacker according to claim 12, further comprising:

a sheet-height detector that detects a position of the sheet during falling as a height position of the sheet falling in a stacking range that is a range in which the sheet is stacked on the tray, wherein when the height position of the falling sheet is higher than a standard value, the predetermined amount of the edge portion of the sheet is controlled to be smaller than the predetermined amount of the edge portion of the sheet used when a height position of the falling sheet is equal to the standard value.

17. The sheet stacker according to claim 16, wherein the standard value is of a falling position of a sheet stored together with a standard value of a falling time of the sheet, where the standard values of the falling time and falling position relative to the length information are determined in advance by experiments as a correlation between the falling time and falling position of the sheet having fallen from the guide in the detaching position.

18. The sheet stacker according to claim 12, further comprising:

a retention timing detector that detects an edge portion of a sequentially transported sheet following the sheet detached from the guide in the detaching position, wherein the controller controls, based on information from the retention timing detector, the guide to reach the standby position at a timing just before the sequentially transported sheet is retained by the guide.

* * * * *